United States Patent [19]

Kawai et al.

[11] Patent Number: 5,001,043

[45] Date of Patent: Mar. 19, 1991

[54] SILVER HALIDE PHOTOGRAPHIC MATERIAL

[75] Inventors: Kiyoshi Kawai; Shigeru Ohno, both of Kanagawa, Japan

[73] Assignee: Fuji Photo Film Co., Ltd., Tokyo, Japan

[21] Appl. No.: 183,947

[22] Filed: Apr. 20, 1988

[30] Foreign Application Priority Data

Apr. 20, 1987 [JP] Japan ..... 62-97206

[51] Int. Cl.[5] ..... G03C 1/825; G03C 7/36

[52] U.S. Cl. ..... 430/522; 430/557

[58] Field of Search ..... 430/557, 522

[56] References Cited

U.S. PATENT DOCUMENTS

| | | | |
|---|---|---|---|
| 3,989,528 | 11/1976 | Sugiyama et al. | 430/522 |
| 4,587,195 | 5/1986 | Ishikawa et al. | 430/522 |
| 4,801,521 | 1/1989 | Ohki et al. | 430/380 |
| 4,833,246 | 5/1989 | Adachi et al. | 430/364 |
| 4,857,449 | 8/1989 | Ogawa et al. | 430/546 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide photographic material containing at least one of the dyes represented by the general formula (I) and containing a coupler represented by the general formula (II) in a blue-sensitive layer:

(I)

wherein $R_1$ and $R_2$ each represents —$COOR_5$ or $R_3$ and $R_4$ each represents a hydrogen atom or an alkyl group, $R_5$ and $R_6$ each represents a hydrogen atom, an alkyl group or an aryl group, $R_5$ and $R_6$ may be bonded to form a 5- or 6-membered ring, $Q_1$ and $Q_2$ each represents an aryl group, $X_1$ and $X_2$ each represents a single bond or bivalent linking group, $Y_1$ and $Y_2$ each represents a sulfo group or a carboxyl group, $L_1$, $L_2$ and $L_3$ each represents a methine group, $m_1$ and $m_2$ each represents 1 or 2, n represents 0, 1 or 2, $p_1$ and $p_2$ each represents 0, 1, 2, 3 or 4 and $s_1$ and $s_2$ each represents 1 or 2;

(II)

wherein $R_8$ represents a substituted or unsubstituted N-phenylcarbamoyl group, $Y_3$ represents a group bonded through an oxygen atom or a nitrogen atom and capable of being released by coupling reaction with an oxidation product of a developing agent. The color photographic material shows excellent sensitivity, developability and sharpness.

15 Claims, No Drawings

SILVER HALIDE PHOTOGRAPHIC MATERIAL

BACKGROUND OF THE INVENTION

1. Field of the Invention

The present invention concerns a silver halide photographic material which has a hydrophilic colloid layer which is photochemically inert and contains a dye easily discolored and/or dissolved out in photographic processing steps and, more particularly, it relates to a silver halide color photographic material which is excellent in image sharpness, has high sensitivity of the blue-sensitive layer and is excellent in the coloring property of the bluesensitive layer and storage stability.

2. Description of the Prior Art

Silver halide color photosensitive material comprises three kinds of silver halide emulsion layers which are selectively synthesized so as to have photosensitivity to blue light, green light and red light, respectively, and usually develop colors of yellow, magenta and cyan, respectively, by using so-called couplers that react with oxidation product of an aromatic primary amine developer to form a dye.

Couplers used in this case are preferably those having desirable coloring property having a coupling rate as high as possible and providing high color density within a restricted time. Further, it is demanded that all of the color developing dyes show less side absorption.

On the other hand, it is required for the formed color photographic images to show satisfactory storage stability under various conditions.

Among them, yellow couplers excellent in coloring property and having high activity are known as disclosed in Japanese Patent Application (OPI) No. 229029/85 (the term "OPI" as used herein refers to a "published unexamined Japanese patent application").

However, even if such an excellent coupler is used, when a multilayer photographic material is prepared, the advantageous properties of these couplers can scarcely be obtained. It has been found that this is due to the reduction of the emulsion sensitivity and developing rate owing to the dyes used in the photosensitive material.

These dyes are mainly used for the following purposes:

(1) For controlling the spectral composition of light incident on the photographic emulsion layer. (filter)

(2) For preventing image blurring (halation) caused by the light transmitting through the photographic emulsion layer which is reflected at the boundary between the emulsion layer and the support, or at the surface of the support on the side opposite to the emulsion layer and again enters the photographic emulsion layer.

(3) For preventing the reduction of the image sharpness (irradiation) due to the light scattering in the photographic emulsion layer.

These layers to be colored are often composed of hydrophilic colloid and, accordingly, water-soluble dyes are usually contained in the layer for coloring them. The dye should satisfy the following requirements:

(1) To have appropriate spectral absorption depending on the use.

(2) To be photochemically inert; not to give chemically undesired effects on the performance of the silver halide photographic emulsion layer, for example, reduction in the sensitivity, reduction of latent image, or fogging.

(3) To be discolored or removed by dissolving in the photographic processing step leaving no harmful coloration in the photographic material after being processed.

A great effort has been made by those skilled in the art for finding the dyes capable of satisfying these requirements and those dyes described below have been known. For instance, oxonol dyes having pyrazolone nuclei or barbituric acid nuclei described in British Patent 506,385, 1,177,429, 1,311,884, 1,338,799, 1,385,371, 1,467,214, 1,433,102, 1,553,516, Japanese Patent Application (OPI) Nos. 85130/72, 114420/74, 161233/80 and 111640/84, U.S. Pat. Nos. 3,247,127, 3,469,985 and 4,078,933; other oxonol dyes described in U.S. Pat. Nos. 2,533,472 and 3,379,533, British Patent 1,278,621, etc.; azo dyes described, for example, in British Patent 575,691, 680,631, 599,623, 786,907, 907,125, 1,045,609, U.S. Pat. No. 4,255,326, Japanese Patent Application (OPI) No. 211043/84, etc. azomethine dyes described in Japanese Patent Application (OPI) Nos. 100116/75, 118247/79 and British Patents 2,014,598 and 750,031; anthraquinone dyes described in U.S. Pat. No. 2,865,752; allylidene dyes described in U.S. Pat. Nos. 2,538,009, 2,688,541 and 2,538,008, British Patents 584,609 and 1,210,252, Japanese Patent Application (OPI) Nos. 40625/75, 3623/76, 10927/76 and 118247/79 and Japanese Patent Publication Nos. 3286/73 and 37303/84; styryl dyes described in Japanese Patent Publication Nos. 3082/53, 16594/69 and 28898/84; triarylmethane dyes described in British Patents 446,583 and 1,335,422 and Japanese Patent Application (OPI) No. 228250/84; merocyanine described in British Patents 1,075,653, 1,153,341, 1,284,730, 1,475,228 and 1,542,807; and cyanine dyes described in U.S. Pat. Nos. 2,843,486 and 3,294,539.

Among them, oxonol dyes having two pyrazolone rings have a nature of being discolored in a liquid developer containing a sulfite salt and have been used for dyeing photosensitive materials as useful dyes giving less undesired effects on photographic emulsions.

However, some dyes belonging to this type may have drawbacks of causing spectral sensitization in unnecessary regions of spectrally sensitized emulsions even if they give little effects on the photographic emulsions per se, or of causing reduction in the sensitivity probably because of the elimination of the sensitizing dye.

Further, along with the speed up of the developing treatment conducted in recent years, some of them may remain after the treatment. In order to overcome this problem, although the use of a dye highly reactive with sulfite ions has been proposed, this causes a defect that the stability in the photographic film is not sufficient and causes reduction with time in the density, thus failing to obtain desired photographic effects.

SUMMARY OF THE INVENTION

An object of the present invention is to provide a silver halide photographic material having a blue-sensitive layer of high sensitivity and excellent color developability obtained by the use of such a novel water-soluble dye as giving no harmful effect on the photographic characteristics of a silver halide emulsion layer.

Another object of the present invention is to provide a silver halide photographic material with the improved sharpness obtained by dyeing a hydrophilic colloid layer with a novel water-soluble dye which is excellent in the discoloring property by processing.

The foregoing objects of the present invention can be attained by a photographic material containing at least one of dyes represented by general formula (I) and containing in the blue-sensitive layer a coupler represented by the general formula (II):

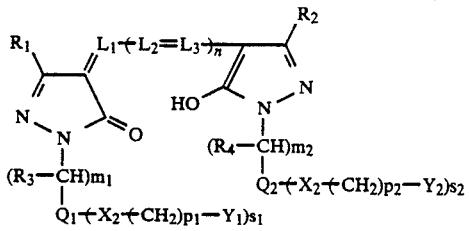

(I)

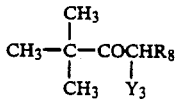

(II)

In general formula (I), $R_1$ and $R_2$ each represents —$COOR_5$ or

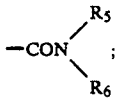

$R_3$ and $R_4$ each represents a hydrogen atom, or an alkyl group (for example, a methyl group or an ethyl group); $R_5$ and $R_6$ each represents a hydrogen atom, an alkyl group (for example, a methyl group, an ethyl group, an isopropyl group or a butyl group), a substituted alkyl group [having a substituent such as a sulfo group (for example, a sulfomethyl group or a sulfoethyl group), a carboxyl group (for example, a carboxymethyl group or a carboxyethyl group), a hydroxy group (for example, a hydroxyethyl group or a 1,2-dihydroxypropyl group), an alkoxy group (for example, a methoxyethyl group or an ethoxyethyl group), a halogen atom (for example, a fluorine atom, a chlorine atom or a bromine atom) (for example, a 2-chloroethyl group, a 2-bromoethyl group or a 2,2,2-trifluoroethyl group), a cyano group (for example, a cyanoethyl group), a sulfonyl group (for example, a methanesrlfonylethyl group), a nitro group (for example, a 2-nitrobutyl group, a 2-nitro-2-methylpropyl group), an amino group (for example, a dimethylaminoethyl group or a diethylaminopropyl group), or an aryl group (for example, a benzyl group or a p-chlorobenzyl group)], or an aryl group [for example, a phenyl group or a substituted phenyl group having a substituent such as a sulfo group (for example, a p-sulfophenyl group, or an o- or p-disulfophenyl group), a carboxyl group (for example, a p-carboxyphenyl group or an m-carboxyphenyl group), a hydroxy group (for example, a p-hydroxyphenyl group or an m-hydroxyphenyl group), an alkoxy group (for example, a p-methoxyphenyl group or an m-ethoxyphenyl group), a halogen atom (for example, a p-chlorophenyl group, a p-bromophenyl group or a p-fluorophenyl group), a cyano group (for example, a p-cyanophenyl group or an o-cyanophenyl group), a nitro group (for example, a p-nitrophenyl group or an m-nitrophenyl group), an amino group (for example, a p-dimethylamino group or a p-diethylaminophenyl group), an alkyl group (for example, a p-methylphenyl group or an o-methylphenyl group)]. When $R_1$ and $R_2$ each represents —$COOR_5$ and if $R_5$ is a hydrogen atom, $R_1$ and $R_2$ each represents a carboxyl group but they may represent not only a free acid but also a salt (for example, an Na salt, a K salt, an ammonium or quaternary ammonium salt). Further, $R_5$ and $R_6$ may be bonded to form a 5-membered ring or a 6-membered ring (for example, a morpholino group or a piperidino group). $Q_1$ and $Q_2$ each represents an aryl group [for example, a phenyl group, a naphthyl group or a substituted phenyl group having a substituent such as an alkyl group with 1 to 4 carbon atoms, an alkoxy group with 1 to 4 carbon atoms, a halogen atom (chloro, bromo or fluoro), a carbamoyl group (for example, an ethylcarbamoyl group), a sulfamoyl group (for example, an ethylsulfamoyl group), a cyano group, a nitro group, an alkylsulfonyl group (for example, a methanesulfonyl group), an arylsulfonyl group (for example, a benzenesulfonyl group), an amino group (for example, a dimethylamino group), an ayclamino group (for example, an acetylamino group), and a sulfonamido group (for example, a methanesulfonamido group)]. $X_1$ and $X_2$ each represents a chemical bond (a single bond) or bivalent linking group, and more particularly, they represent —O—,

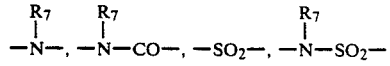

or a single bond, $R_7$ represents a hydrogen atom, an alkyl group with 5 or less carbon atoms, a substituted alkyl group with 5 or less carbon atoms [having a substituent such as an alkoxy group with 3 or less carbon atoms, a sulfo group (for example, a sulfoethyl group or a sulfopropyl group), a carboxyl group (for example, a carboxyethyl group), a cyano group, a hydroxy group (for example, a hydroxyethyl group), an amino group, a sulfonamido group (a methanesulfonamido group), a carbonamido group (for example, an acetylamino group), a carbamoyl group (for example, an ethylaminocarbonyl group), a sulfamoyl group (for example, an ethylaminosulfonyl group)]. $Y_1$ and $Y_2$ each represents a sulfo group or a carboxyl group and they may represent not only a free acid but also a salt (for example, an Na salt, a K salt an ammonium salt or a quaternary ammonium salt). $L_1$, $L_2$ and $L_3$ each represents a methine group [also containing a substituted methine group (having a substituent such as a methyl group, an ethyl group or a phenyl group)]. $m_1$ and $m_2$ each represents 1 or 2, n represents 0, 1 or 2, $p_1$ and $p_2$ each represents 0, 1, 2, 3 or 4 and $s_1$ and $s_2$ each represents 1 or 2.

Among the substituents in general formula (I), $R_3$ and $R_4$ are preferably a hydrogen atom or a methyl group, $R_5$ and $R_6$ are preferably a hydrogen atom, an alkyl group with 4 or less carbon atoms, a substituted alkyl group with 6 or less carbon atoms (having a substituent such as a sulfo group, a carboxyl group, a hydroxyl group, an alkoxy group with 2 or less carbon atoms, a chlorine atom, a cyano group, an amino group or an alkylamino group with 4 or less carbon atoms), a phenyl group, or a substituted phenyl group (having a substituent such as a sulfo group, a carboxyl group, an alkoxy group with 4 or less carbon atoms, a chlorine atom, a cyano group, an alkyl group with 4 or less carbon atoms, an amino group, or an alkylamino group with 4 or less carbon atoms), $R_5$ and $R_6$ may be bonded to form a 5-membered ring or a 6-membered ring (for example, a morpholino ring, a pyrrolidine ring, a piperidine ring).

$Q_1$ and $Q_2$ are preferably a phenyl group or a substituted phenyl group [having a substituent such as an alkyl group with 4 or less carbon atoms, an alkoxy group with 4 or less carbon atoms, a halogen atom (a chloro, bromo or fluoro), a dialkylamino group with 4 or less carbon atoms], etc.

$X_1$ and $X_2$ are preferably —O—,

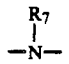

or a chemical bond, in which R is preferably a hydrogen atom, an alkyl group with 5 or less carbon atoms, a substituted alkoxy group with 5 or less carbon atoms (having a substituent such as an alkoxy group with 3 or less carbon atoms, a cyano group, a hydroxyl group or an alkylamino group with 4 or less carbon atoms).

Further, among the dyes represented by general formula (I), preferably $m_1 = m_2 = 1$.

$R_8$ in general formula (II) represents an N-phenylcarbamoyl group, in which the phenyl group may contain a substituent. If there are two or more substituents, they may be the same or different. The acceptable substituents include the following.

An aromatic group (for example, a phenyl group or a naphthyl group), a heterocyclic group (for example, a 2-pyridyl group, a 2-imidazolyl group, a 2-furyl group or a 6-quinolyl group), an aliphatic oxy group (for example, a methoxy group, a 2-methoxyethoxy group or a 2-propenyloxy group), an aromatic oxy group (for example, a 2,4-di-tert-amylphenoxy group, a 4-cyanophenoxy group or a 2-chlorophenoxy group), an acyl group (for example, an acetyl group or a benzoyl group), an ester group (for example, a butoxycarbonyl group, a phenoxycarbonyl group, an acetoxy group, a benzoyloxy group, a butoxysulfonyl group or a toluenesulfonyloxy group), an amido group (for example, an acetylamino group, a methanesulfonamido group, an ethylcarbamoyl group or a methylsulfamoyl group), an imido group (for example, a succinimido group or a hydantoinyl group), a ureido group (for example, a phenylureido group or a dimethylureido group), an aliphatic or aromatic sulfonyl group (for example, a methanesulfonyl group or a phenylsulfonyl group), an aliphatic or aromatic sulfamoyl group, an aliphatic or aromatic thio group (for example, a phenylthio group or an ethylthio group), a hydroxyl group, a cyano group, a carboxyl group, a nitro group, a sulfonic group, a halogen atom (for example, a fluorine, fluorine or bromine atom).

Preferred $R_8$ represented by the following general formula (A):

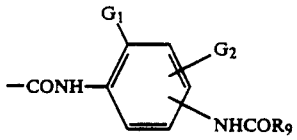

(A)

wherein $G_1$ represents a halogen atom or an alkoxy group and $G_2$ represents a hydrogen atom, a halogen atom or an alkyl group which may have a substituent and $R_9$ represents an alkyl group which may have a substituent.

The substituent $G_2$ and $R_9$ in general formula (A) can include, typically, an alkyl group, an alkoxy group, an aryl group, an aryloxy group an amino group, a dialkylamino group, a heterocyclic group (for example, an N-morpholino group, an N-piperidino group or a 2-furyl group), a halogen atom, a nitro group, a hydroxy group, a carboxyl group, a sulfo group or an alkoxycarbonyl group.

Preferred releasable group $Y_3$ may include the groups represented by the following general formulae from (B) to (E):

$$-OR_{10} \quad \text{(B)}$$

wherein $R_{10}$ represents an aryl group or a heterocyclic group which may be further substituted.

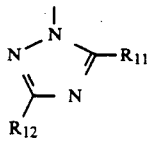

(C)

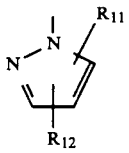

(D)

wherein $R_{11}$ and $R_{12}$ each represents a hydrogen atom, a halogen atom, a carboxylic acid ester group, an amino group, an alkyl group, an alkylthio group, an alkoxy group, an alkylsulfonyl group, an alkylsulfinyl group, a carboxyl group, a sulfo group, an unsubstituted or substituted phenyl group, or a heterocyclic ring, which may be the same or different.

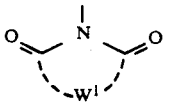

(E)

wherein $W_1$ represents a nonmetal atom required for forming a 4-membered, a 5-membered, or a 6-membered ring together with

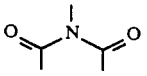

in the formula

Among those represented by general formula (E), the following formulae (E-1) to (E-3) are preferred:

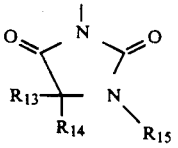

(E-1)

-continued (E-2)

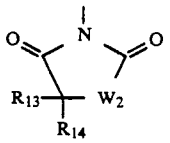

(E-3)

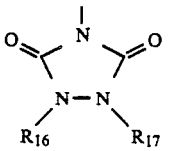

wherein $R_{13}$ and $R_{14}$ each represents a hydrogen atom, an alkyl group, an aryl group, an alkoxy group, an aryloxy group or a hydroxyl group, $R_{15}$, $R_{16}$ and $R_{17}$ each represents a hydrogen atom, an alkyl group, an aryl group, an aralkyl group or an acyl group and $W_2$ represents an oxygen or sulfur atom.

The alkyl group (residue) or an aryl group (aryl residue) in the groups represented by the above-mentioned general formulae may further be substituted with the substituent described above.

Specific examples of the dyes used in the present invention are shown below, but the invention is no way restricted thereto.

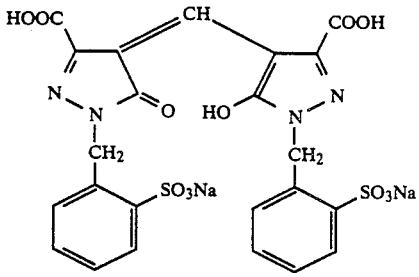

I-1

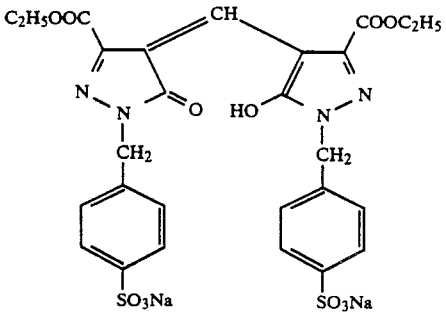

I-2

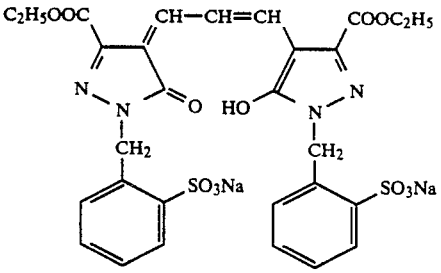

I-3

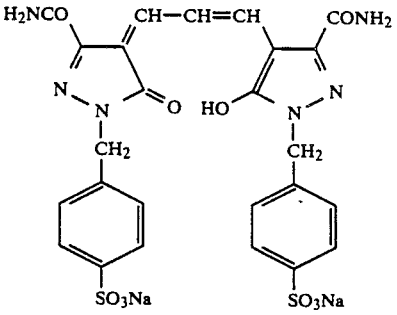

I-4

-continued
I-5
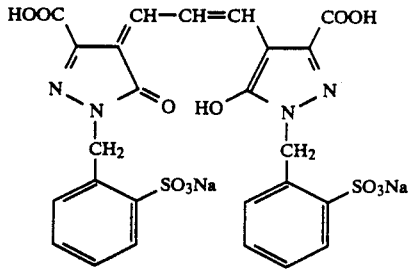
I-6
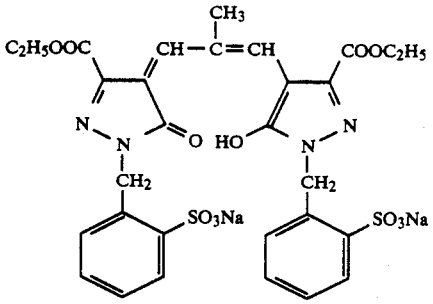
I-7
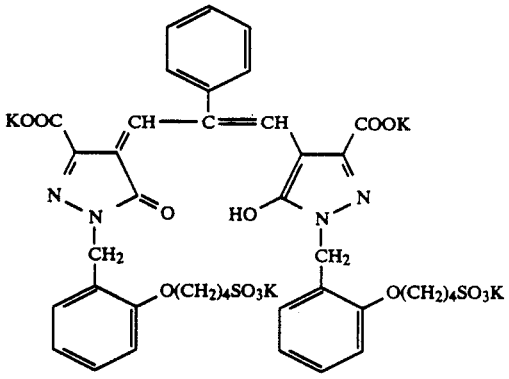
I-8
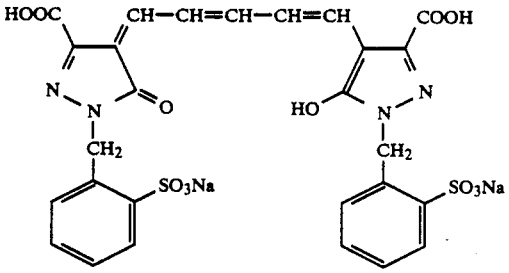
I-9
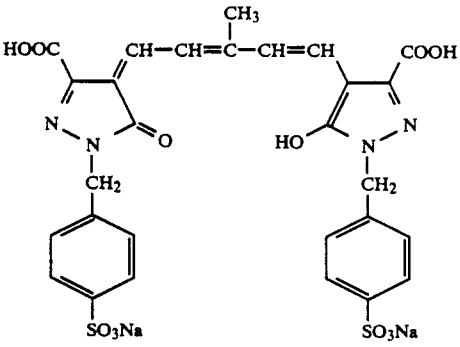

-continued
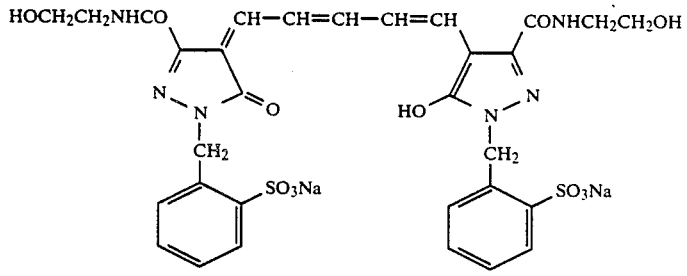
I-10
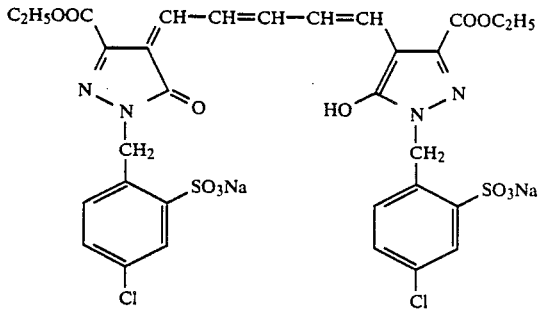
I-11
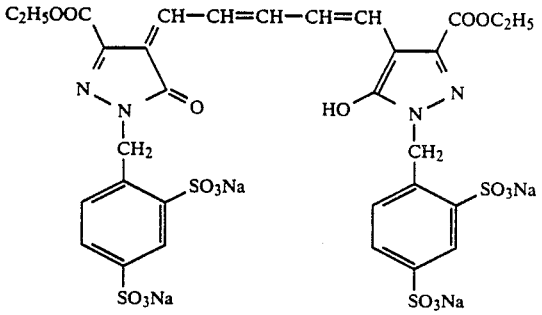
I-12
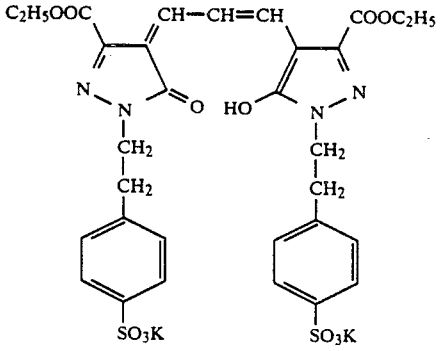
I-13
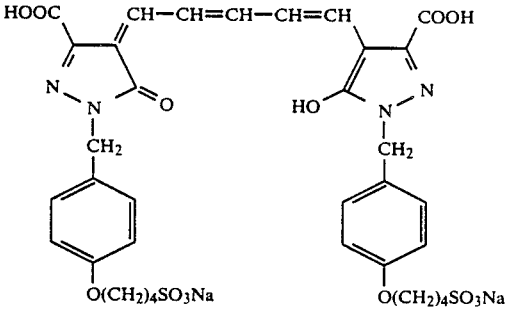
I-14

-continued
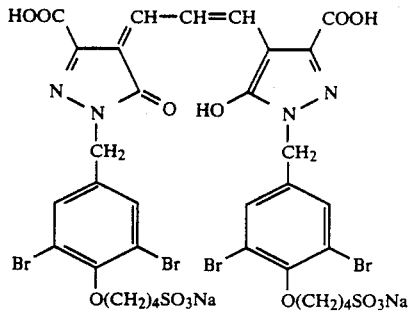
I-15
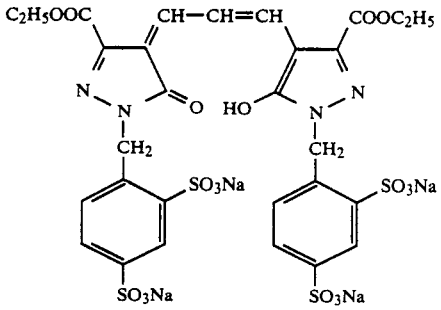
I-16
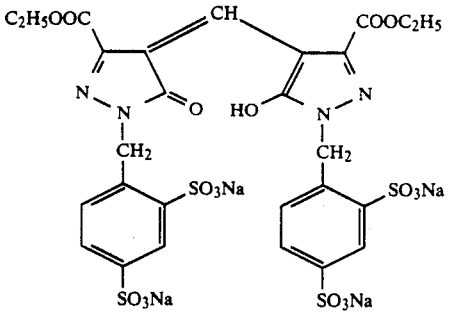
I-17
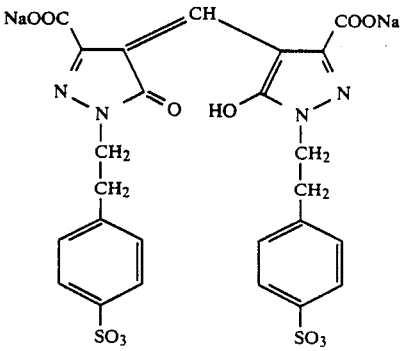
I-18
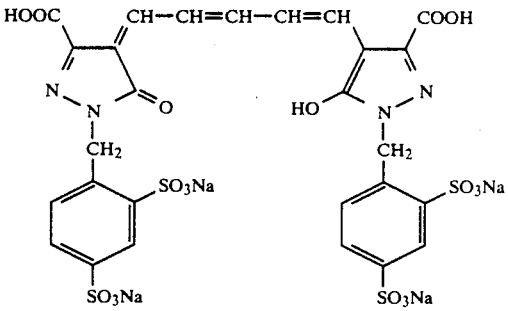
I-19

-continued
I-20
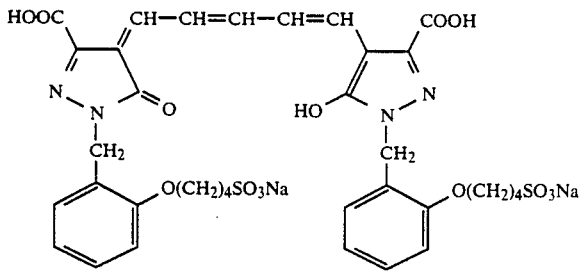
I-21
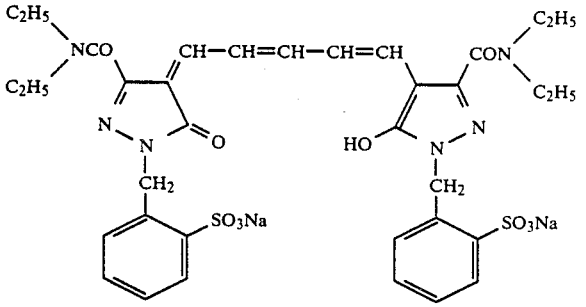
I-22
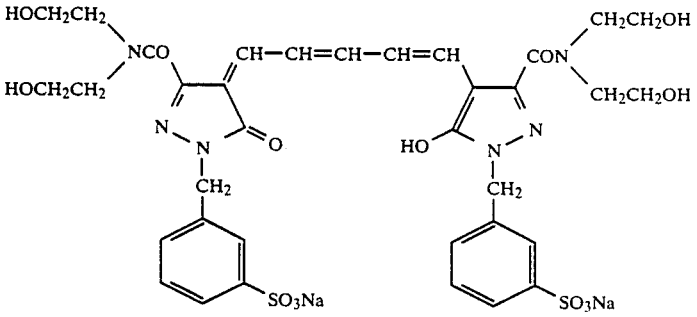
I-23
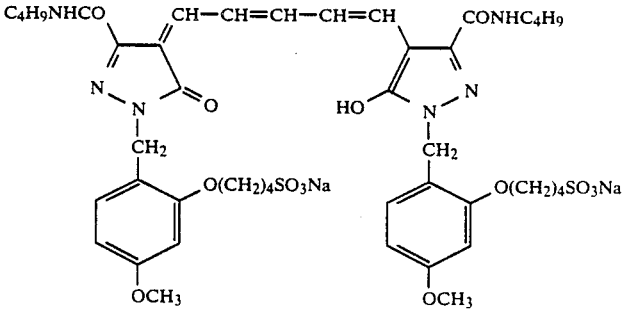
I-24
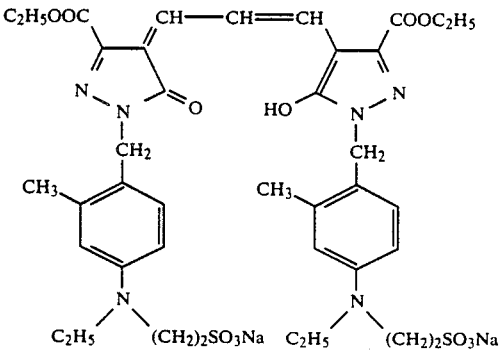

-continued
I-25
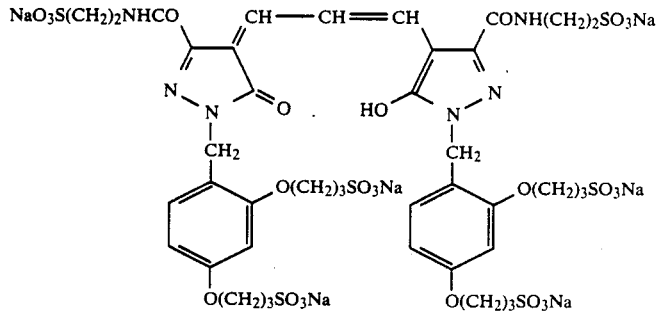
I-26
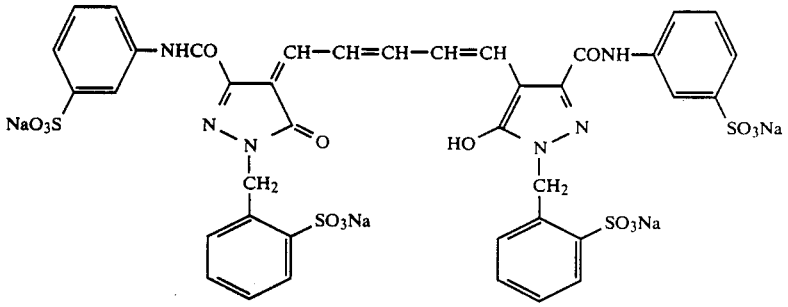
I-27
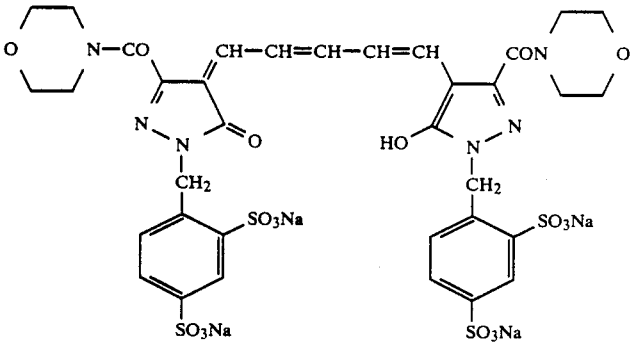
I-28
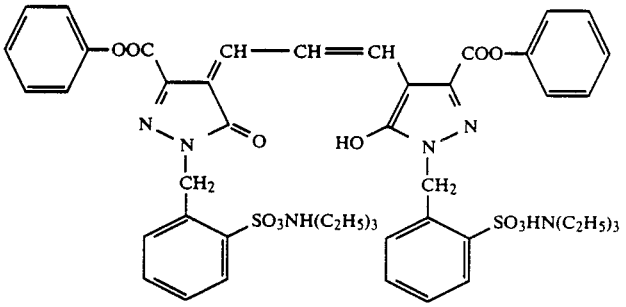
I-29
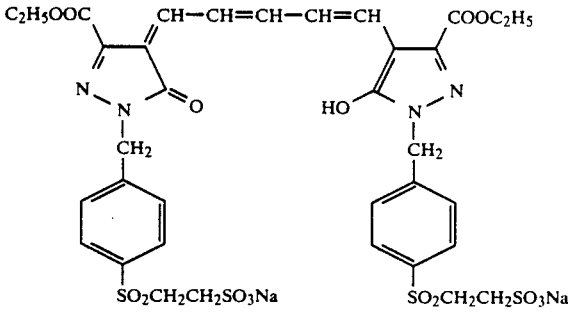

-continued
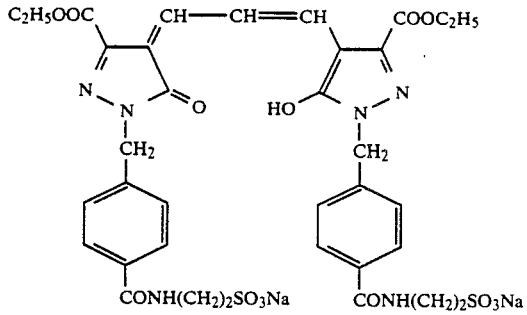
I-30
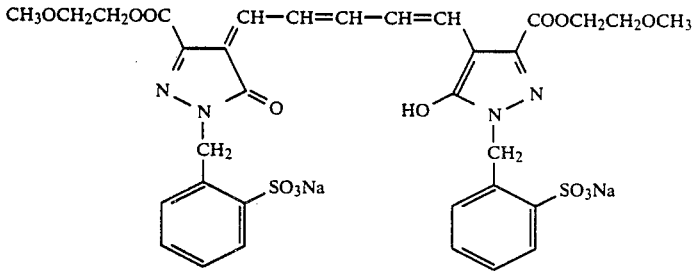
I-31
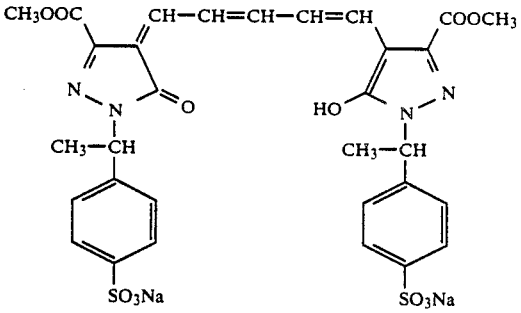
I-32
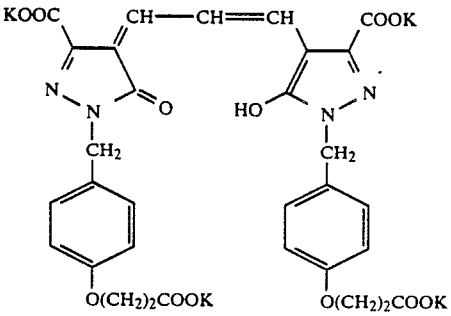
I-33
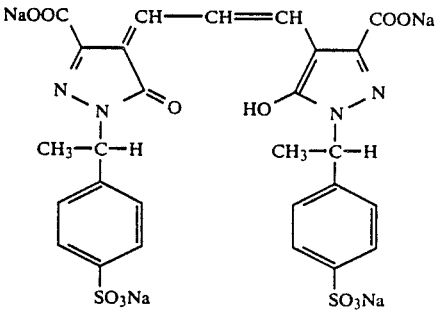
I-34

-continued
I-35
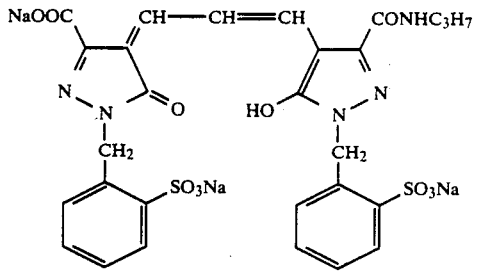
I-36
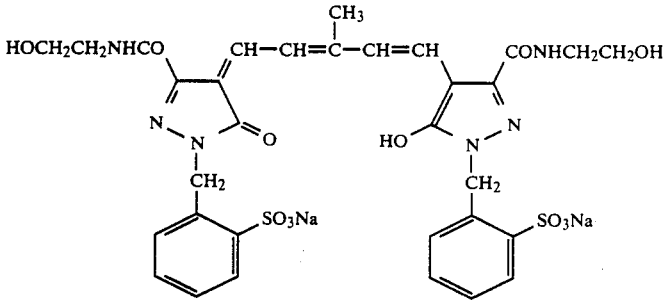
I-37
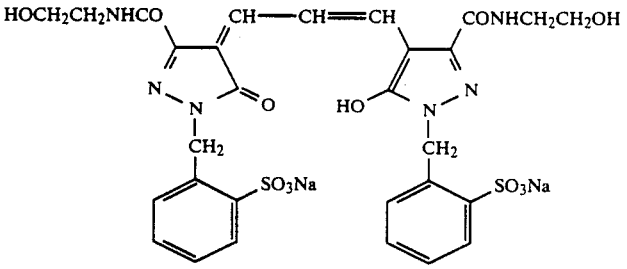
I-38
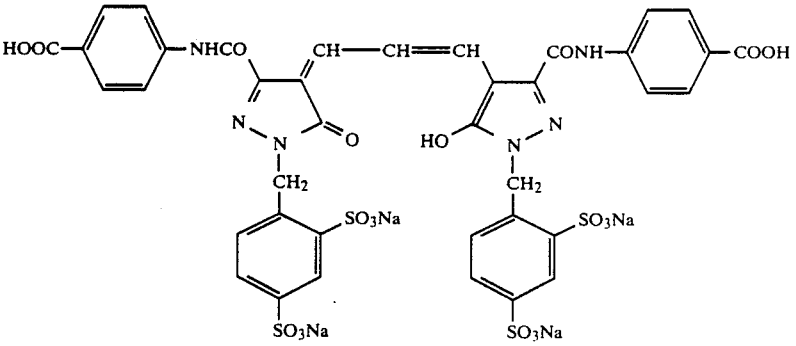
I-39
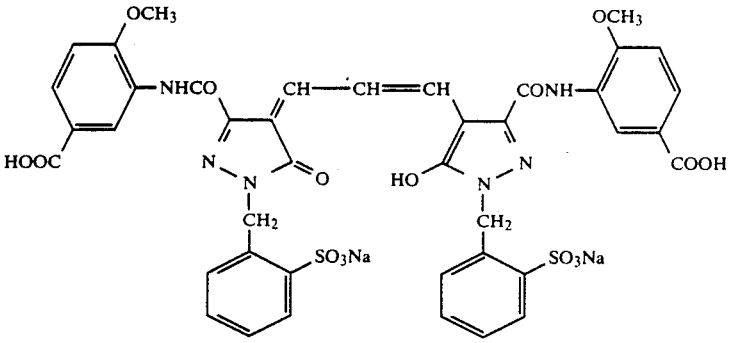

-continued
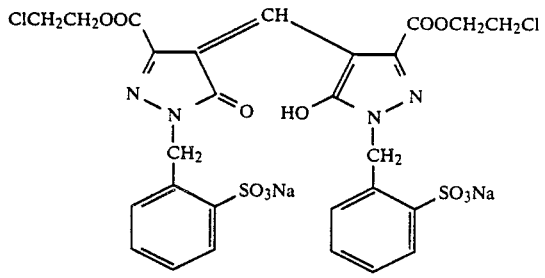
I-40
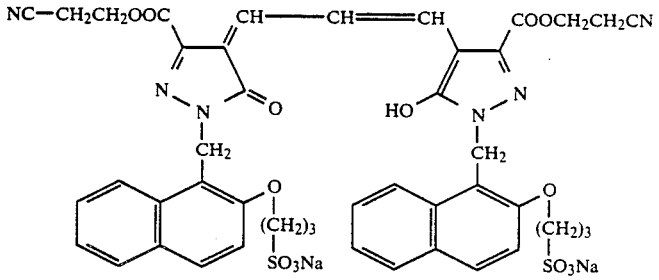
I-41
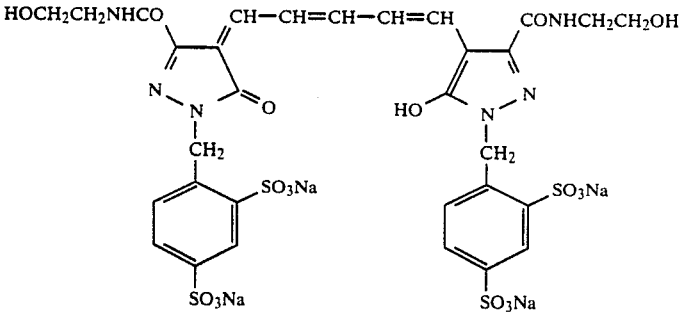
I-42
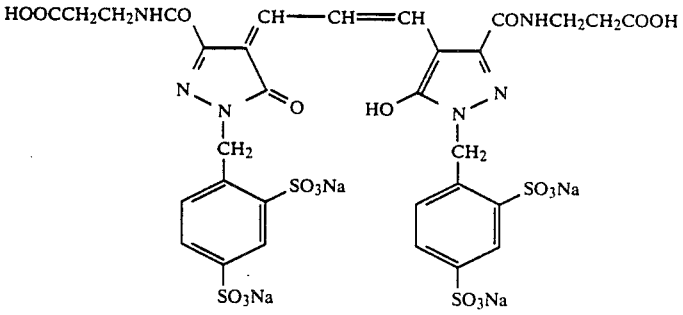
I-43
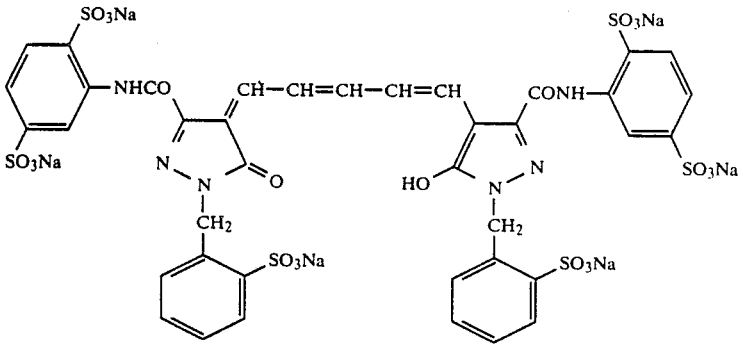
I-44

-continued
I-45
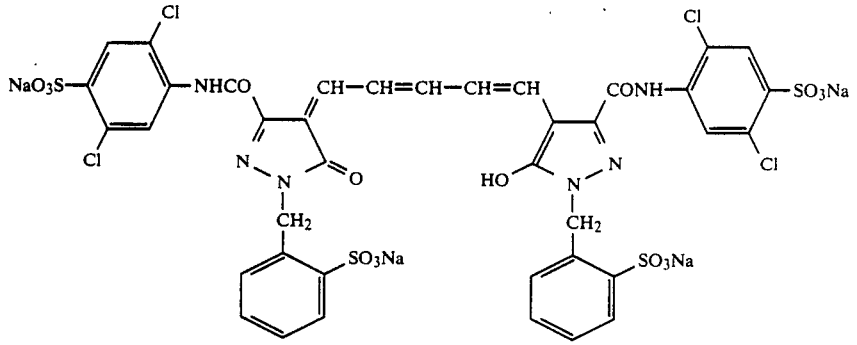
I-46
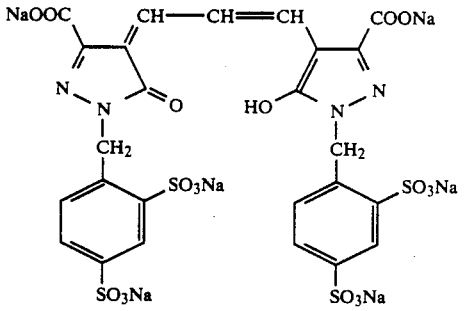
I-47
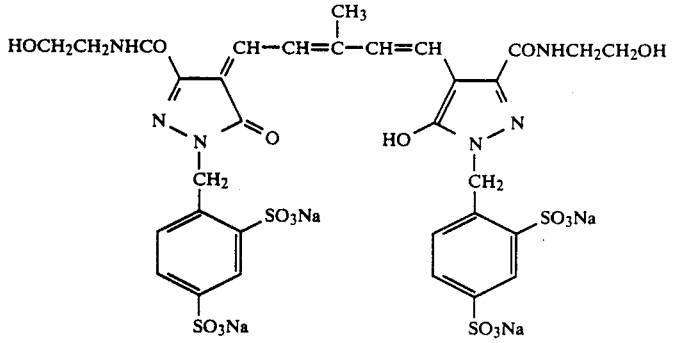
I-48
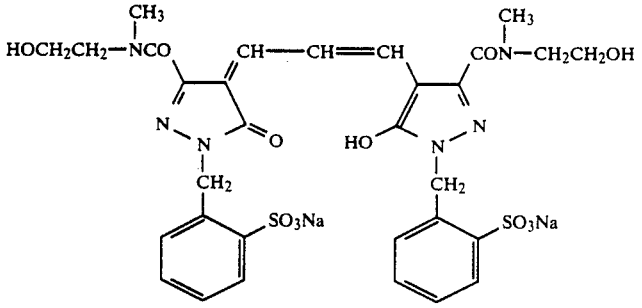
I-49
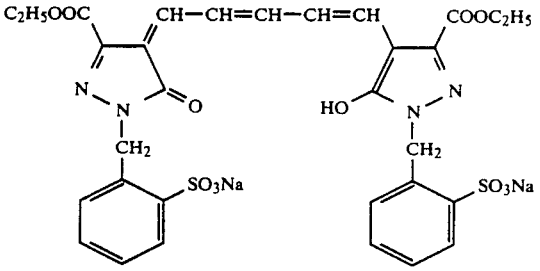

-continued
I-50
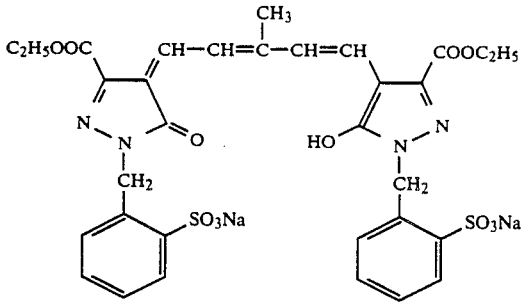
I-51
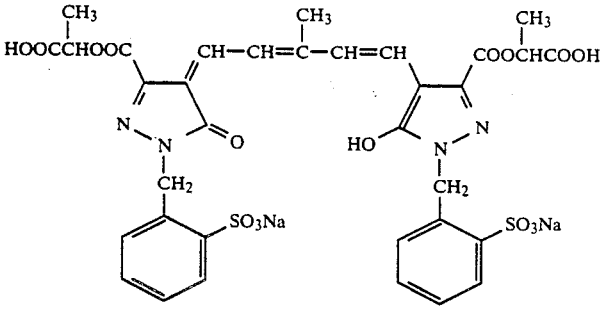
The compound of the general formula, (II) is described, for example, in Japanese Patent Application (OPI) No. 48541/79, Japanese Patent Publication No. 10739/83, U.S. Pat. No. 4,326,024 and *Research Disclosure* 18053, etc.
Specific examples of the compounds represented by general formula (II) are shown below but the, present invention is no way limited only to these exemplified compounds.
(Y-1)
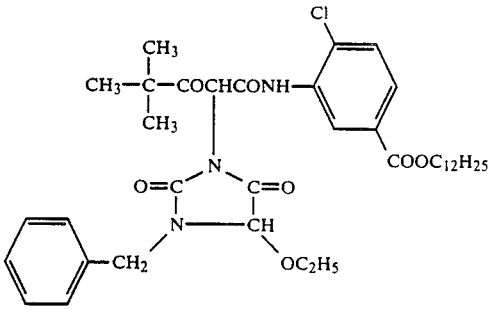
(Y-2)
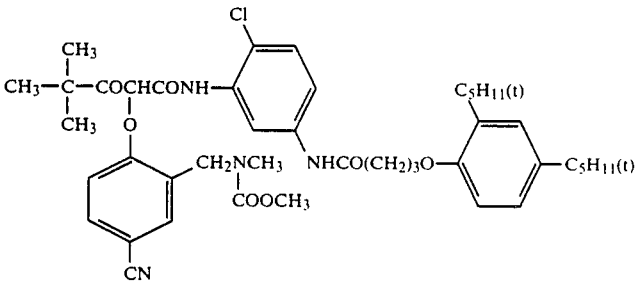
(Y-3)
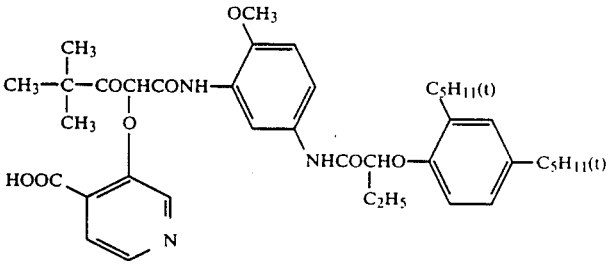

-continued
(Y-4)
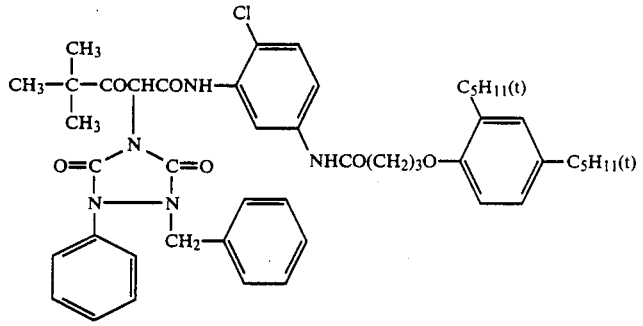
(Y-5)
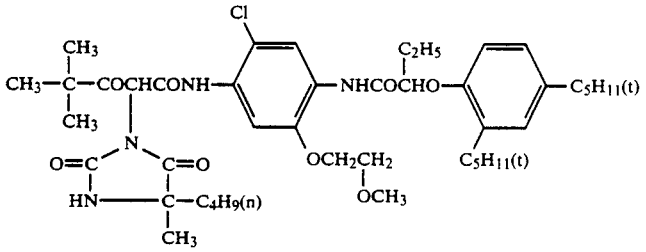
(Y-6)
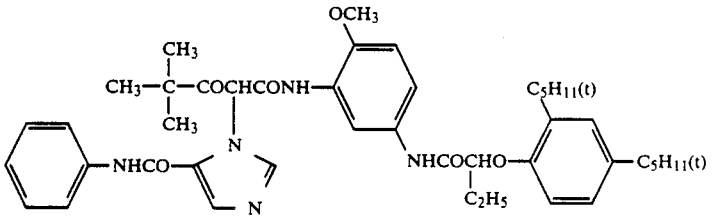
(Y-7)
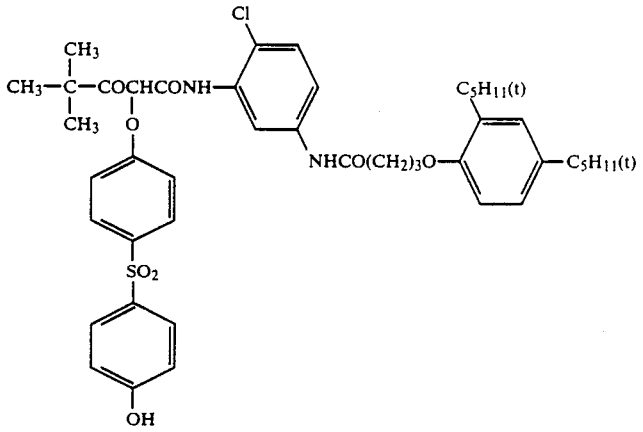

-continued
(Y-8)
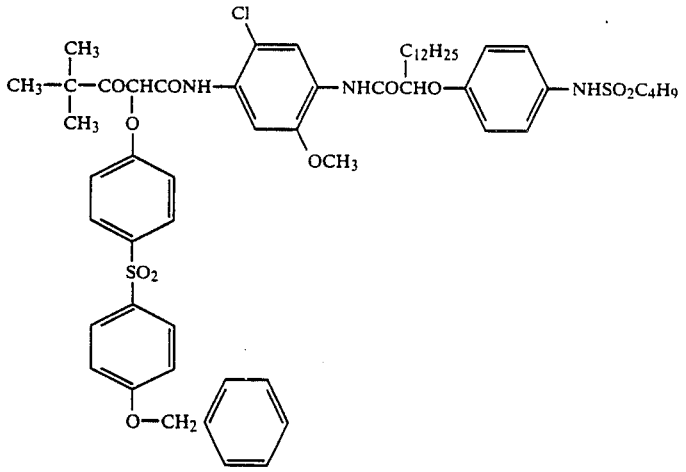
(Y-9)
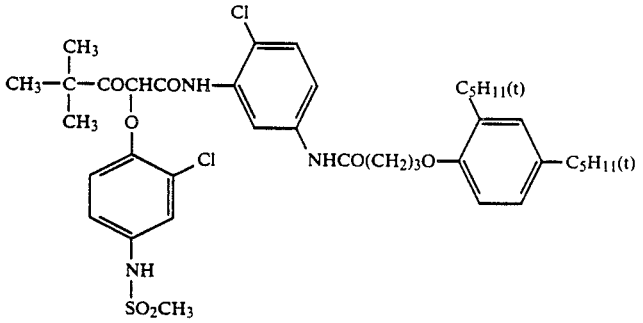
(Y-10)
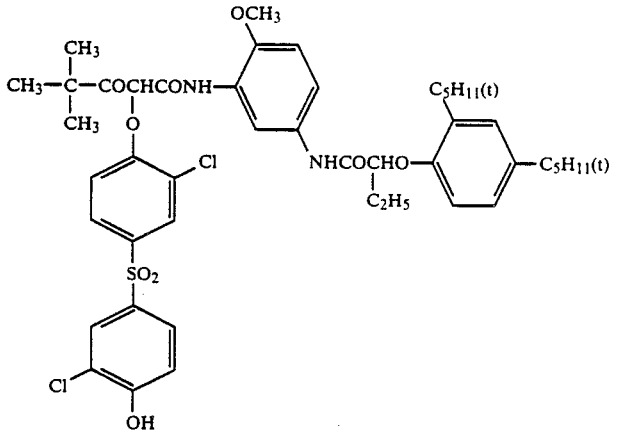
(Y-11)
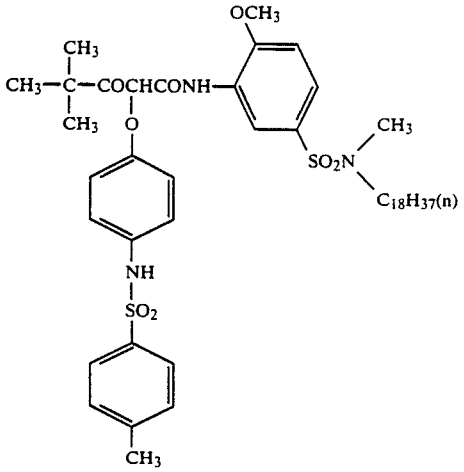

-continued
(Y-12)
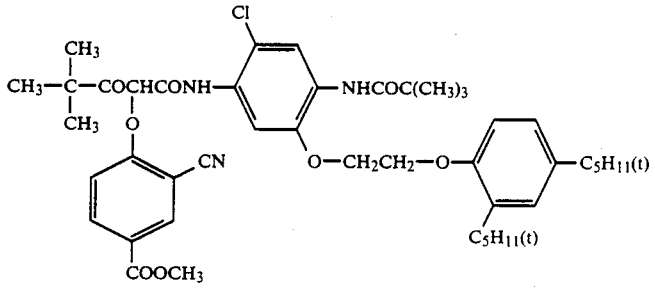
(Y-13)
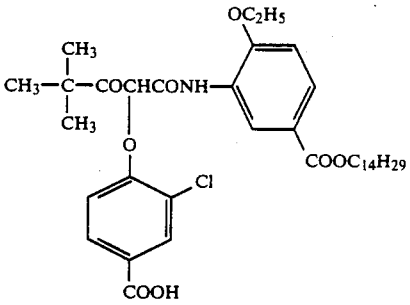
(Y-14)
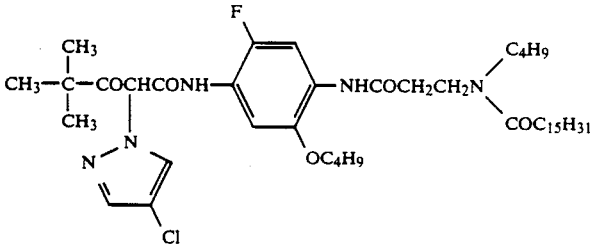
(Y-15)
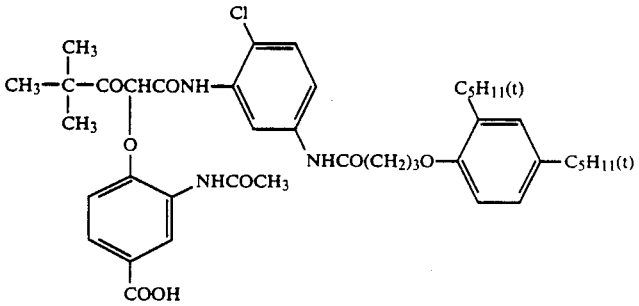
(Y-16)
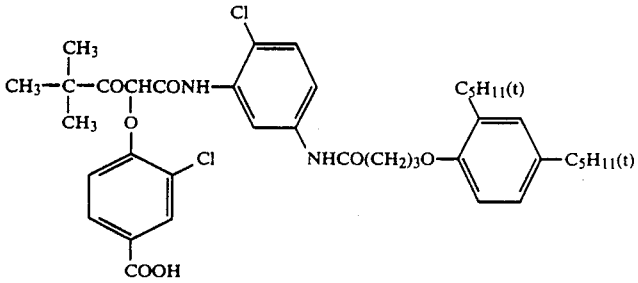

-continued
(Y-17)
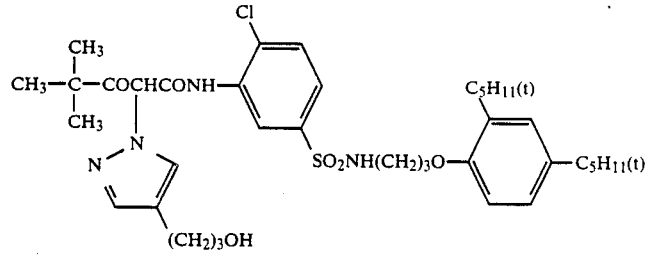
(Y-18)
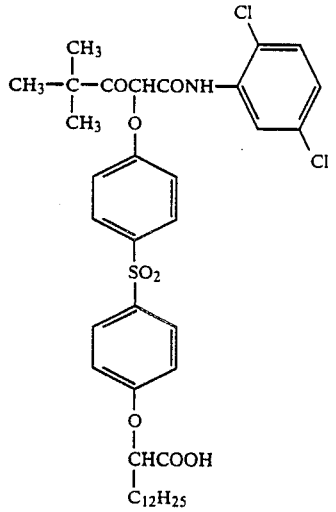
(Y-19)
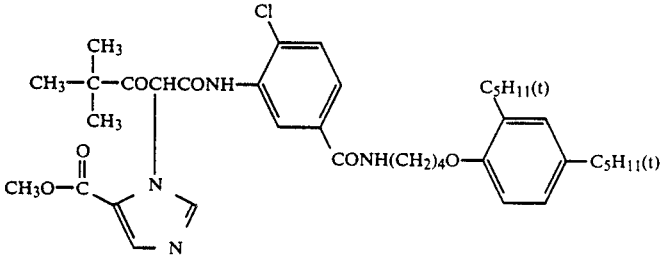
(Y-20)
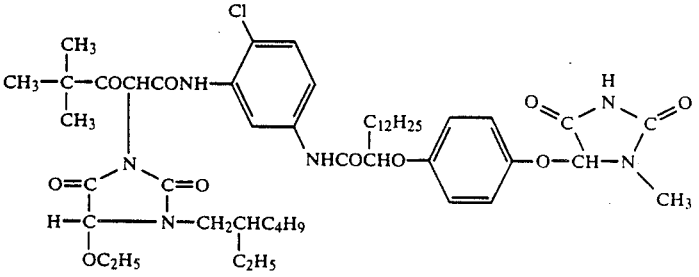
(Y-21)
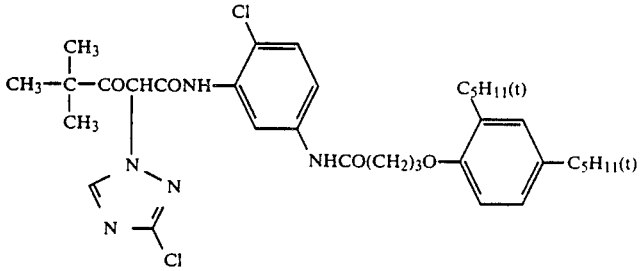

-continued
(Y-22)
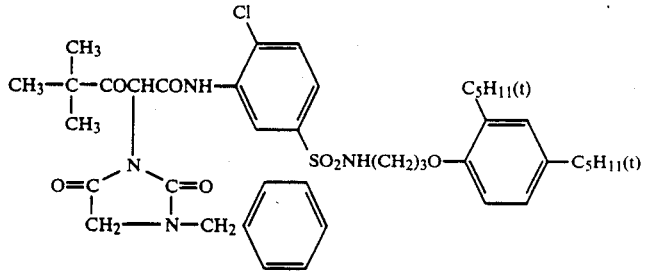
(Y-23)
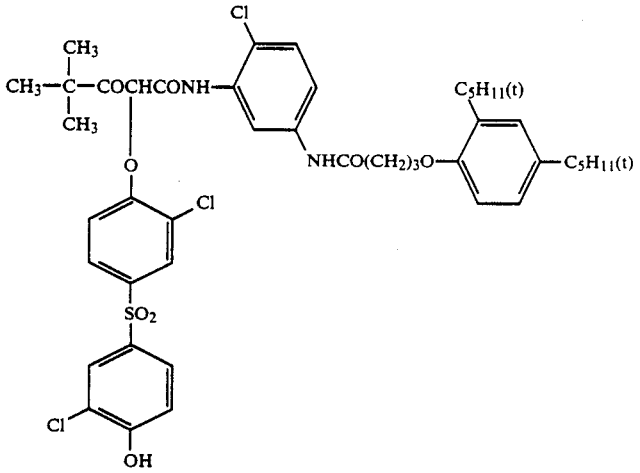
(Y-24)
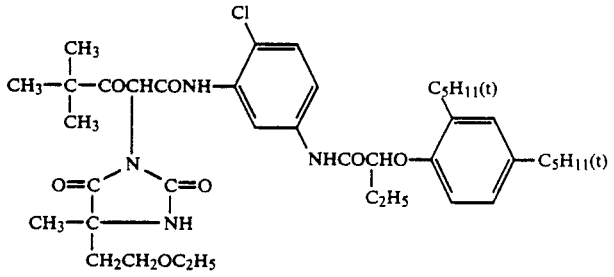
(Y-25)
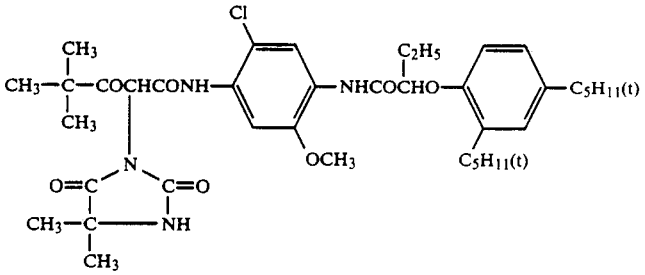
(Y-26)
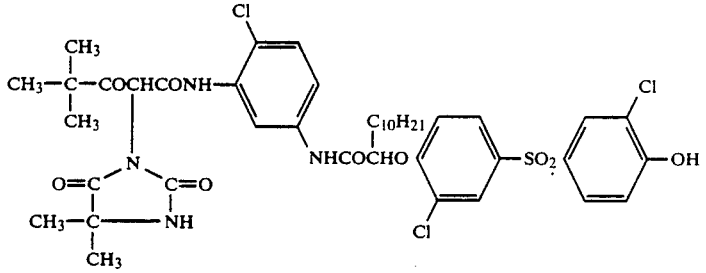

-continued
(Y-27)
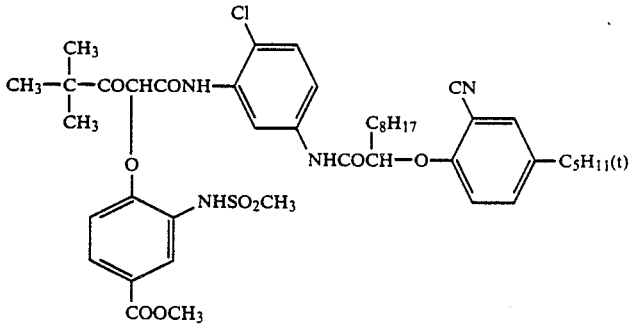
(Y-28)
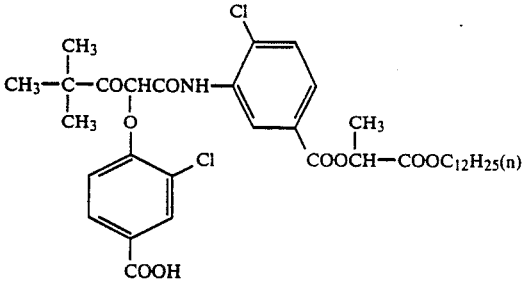
(Y-29)
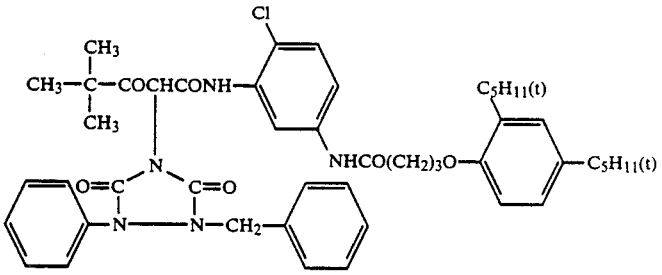
(Y-30)
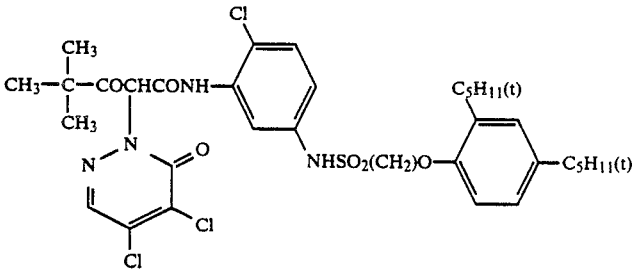
(Y-31)
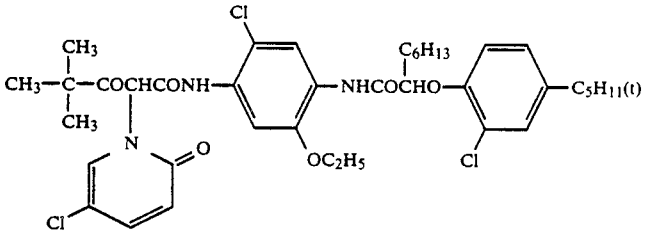
(Y-32)
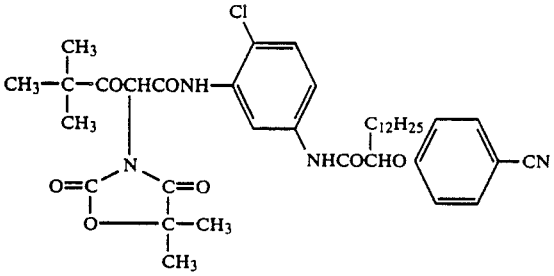

-continued
(Y-33)
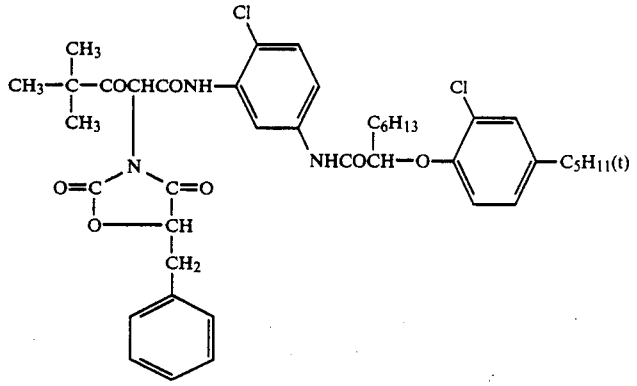
(Y-34)
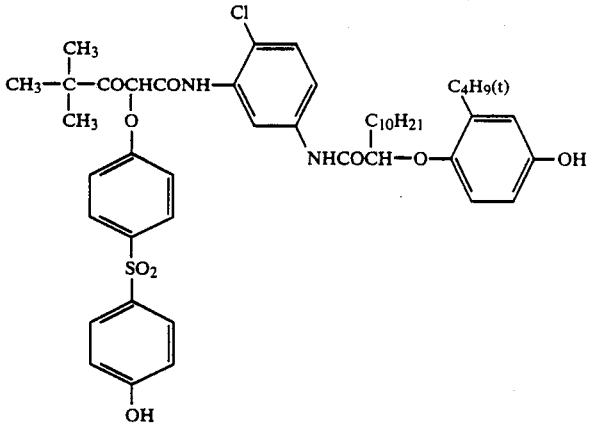
(Y-35)
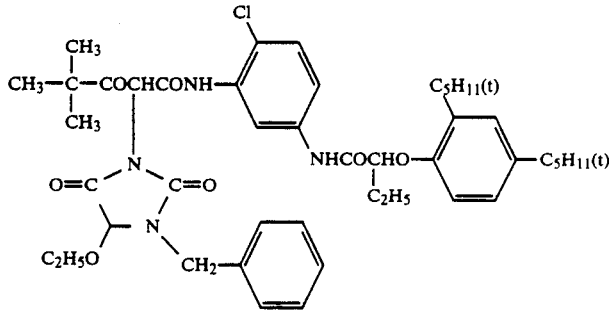
(Y-36)
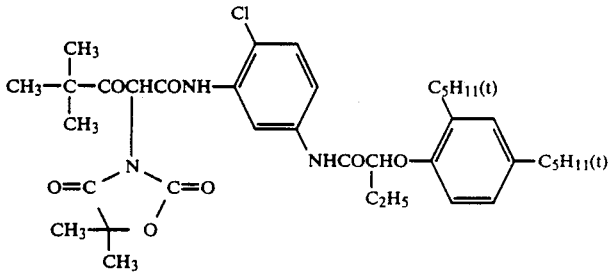

-continued
(Y-37)
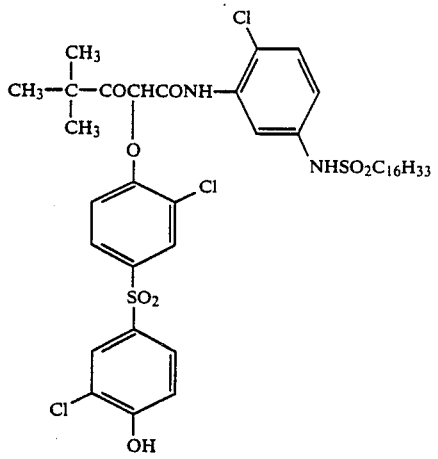
(Y-38)
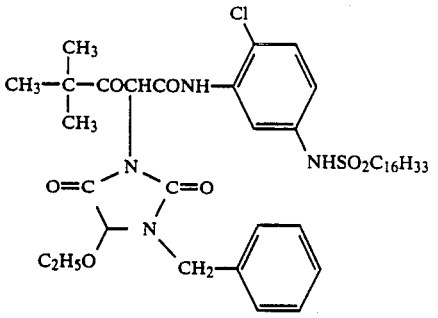
(Y-39)
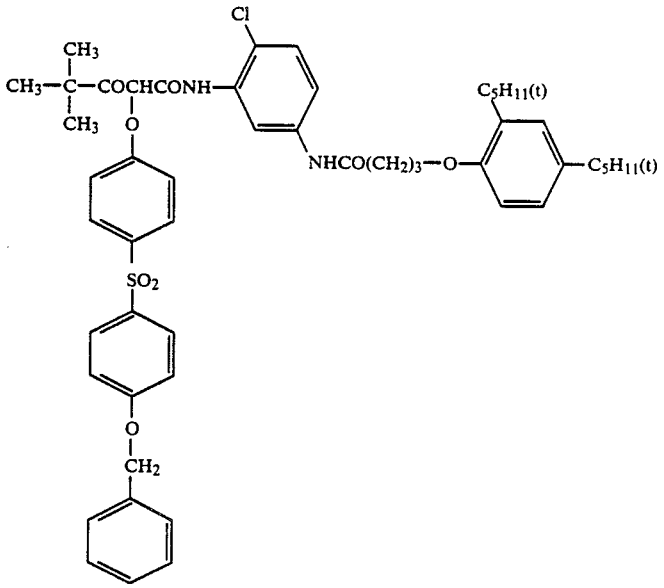
(Y-40)
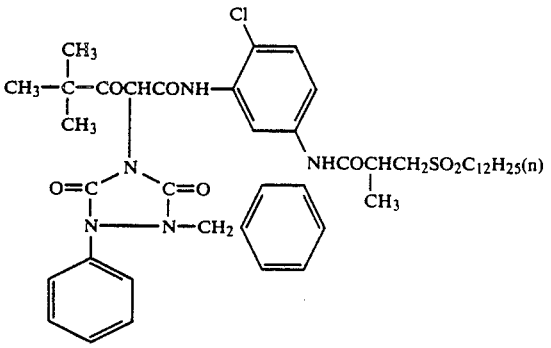

-continued (Y-41)

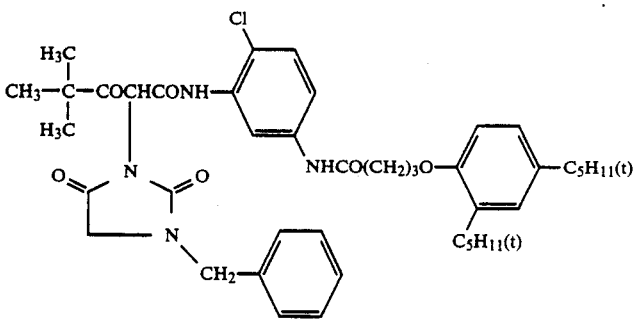

When the dye represented by general formula (I) is used as the filter dye, anti-irradiation dye or antihalation dye, they may be used in any desired effective amount and used preferably such that the optical density is within a range from 0.5 to 3.0. For the time of addition, they may be added at any step before coating.

The dye according to the present invention can be dispersed in various known methods in the emulsion layer or other hydrophilic colloid layer (an intermediate layer, a protective layer, an antihalation layer, a filter layer, etc.)

(1) A method of directly dissolving or dispersing the dyes of the present invention into the emulsion layer or hydrophilic colloid layer, or a method of dissolving or dispersing them in an aqueous solution or a solvent and then using the same for the emulsion layer or hydrophilic colloid layer They may be added to the emulsion in the form of a solution dissolved in an adequate solvent, for example, methanol, ethanol, propanol, methyl cellosolve, halogenated alcohol described in Japanese Patent Application (OPI) No. 9715/73 and U.S. Pat. No. 3,756,830, acetone, water, pyridine or the mixed solvents thereof.

(2) A method of incorporating a hydrophilic polymer having the opposite electric charge to those of the dye ions in the layer as the mordant dye and localizing the dye in a specific layer due to the interaction with the dye molecules.

The polymer mordant dye includes polymers containing secondary or tertiary amino groups, polymers having nitrogen-containing heterocyclic portions or polymers containing quaternary cationic groups thereof, having molecular weight, preferably, of greater than 5,000 and, particularly preferably, of greater than 10,000. There can be mentioned, for example, vinyl pyridine polymers and vinyl pyridinium cation polymers described in U.S. Pat. No. 2,548,564, etc.; vinyl imidazolium cation polymers described in U.S. Pat. No. 4,124,386; polymeric mordant dyes capable of crosslinking with gelatin, etc., disclosed in U.S. Pat. No. 3,625,694; aqueous sol type mordant dyes described in U.S. Pat. No. 3,958,995 or Japanese Patent Application (OPI) No. 115228/79; water-insoluble mordant dyes disclosed in U.S. Pat. No. 3,898,088; reactive mordant dyes capable of covalent bonding with the dyes described in U.S. Pat. No. 4,168,976; polymers derived from ethylenically unsaturated compounds having dialkyl aminoalkyl ester residue described in British Patent 684,475; products obtained by the reaction between polyvinyl alkyl ketone and amino guanidine described in British Patent 850,281; and polymers derived from 2-methyl-1-vinyl-imidazole described in U.S. Pat. No. 3,145,231.

(3) Method of dissolving the compound using a surface active agent.

The useful surface active agent may either be an oligomer or polymer.

Details for the polymers are described in the specification of Japanese Patent Application (OPI) No. 158437/85, pp. 19–27 (filed by Fuji Photo Film Co. Ltd., on Jan. 26, 1984).

Further, hydrosols of oleophilic polymers described, for example, in Japanese Patent Publication No 39835/76 may be added to the hydrophilic colloid dispersions obtained as described above.

While gelatin is a typical hydrophilic colloid, any of hydrophilic colloids that are known as usable for photographic use may be used.

The coupler represented by general formula (II) is usually contained in an amount of from 0.1 to 1.0 mol, preferably from 0.1 to 0.5 mol, per mol of the silver halide in the silver halide emulsion layer constituting the blue-sensitive layer.

The silver halide grains used in the present invention may include those of regular crystal forms such as cubic or octahedral configuration, irregular crystal forms such as spherical or tabular configuration or those of hybrid type of these crystal forms. Further, a mixture comprising grains of various crystal forms may also be used.

The silver halide grains used in the present invention may have the phase in which the interior and the surface layers are different or uniform. Furthermore, those grains in which latent images are mainly formed at the surface (for example, negative type emulsion) or those grains in which latent images are mainly formed to the inside of the grains (for example, internal latent type emulsion, prefogged direct reversion type emulsion) may be used.

The silver halide emulsion layer used in the present invention may either be a tabular grain emulsion having the thickness of less than 0.5 μm, preferably less than 0.3 μm, the diameter of preferably greater than 0.6 μm, and the ratio of the grain with the average aspect ratio of 5 or greater being more than 50% of the total projection area, or a monodispersed emulsion having the statistical variation coefficient (a value S/d obtained by dividing the standard deviation S with the diameter d in a case where the projected area is approximated as a circle) is less than 20%. Further, a mixture of two or more of such tabular grain emulsions or monodispersed emulsions may be used.

The photographic emulsion used in the present invention can be prepared by the methods described in P. Glafkides, *Chimie et Physique Photographique*, Paul Montel Co., 1967; G.F. Duffin, *Photographic Emulsion Chemistry*, The Focal Press, 1966; V.L. Zelikman, et al., *Making and Coating Photographic Emulsion*, The Focal Press, 1964, etc.

Further, in forming the silver halide grains, silver halide solvents may be used for controlling the growth of the grains and they include, for example ammonia, potassium rhodanide, antimony rhodanide, thioether compounds (for example, those described in U.S. Pat. No. 3,271,157, 3,574,628, 3,704,130, 4,297,439 and 4,276,374), thione compounds (for example, those described in Japanese Patent Application (OPI) Nos. 144319/78, 82408/78 and 77737/80) and amine compounds (for example, those described in Japanese Patent Application (OPI) No. 100717/79).

In the course of forming or physically aging the silver halide grains, cadmium salts, zinc salts, thallium salts, indium salts or complex salts thereof, rhodium salts or complex salts thereof, iron salts or iron complexes, etc., may be present together.

The silver halide emulsion is usually chemically sensitized. For the chemical sensitization, it is possible to use the method described, for example, in *Die Grundlagen der Photographischen Prozesse mit Silberhalogeniden*, H. Frieser, Ed., Akademische Verlagsgesellschaft, 1968, pp. 675–734.

That is, it is possible to employ a sulfur sensitizing method using a sulfur-containing compound capable of reacting with an active gelatin or silver (for example, thiosulfates, thioureas, mercapto compounds, rhodanines); a reduction sensitization method using reducing substances (for example, stannous salts, amines, hydrazine derivatives, formamidinesulfinic acid, silane compounds, etc.); and a noble metal sensitizing method using noble metal compounds (for example, gold complex salts or complex salts of metals belonging to the group VIII of the Periodic Table such as Pt, Ir, Pd), alone or in combination.

Various compounds may be incorporated into a silver halide photographic emulsion used in the present invention for preventing fogging of the photosensitive material during preparation step, storage or photographic processing, or for stabilizing the photographic performance. That is, various compounds known as antifoggant or stabilizer can be added, for example, azoles such as benzothiazolium salts, nitroindazoles, triazoles, benzotriazoles and benzimidazoles (particularly, nitro- or halogen-substituted products); heterocyclic mercapto compounds such as mercaptothlazoles, mercaptobenzothiazoles, mercaptobenzbenzimidazoles, mercaptothiadiazoles, mercaptotetrazoles (particularly, 1-phenyl-5-mercaptotetrazole), mercaptopyrimidines; the heterocyclic mercapto compounds described above and having watersoluble groups such as carboxyl group or sulfo groups; thioketo compounds such as oxazolinethione; azaindenes such as tetraazaindenes (particularly, 4-hydroxysubstituted (1,3,3*a*,7)tetraazindenes); benzenethiosulfonic acids; benzenesulfinic acids; etc.

The silver halide photographic material according to the present invention includes preferably red-sensitive layers and green-sensitive layers as the photosensitive layer in addition to blue-sensitive layers. These layers each contains dispersing compounds of cyan coupler and magenta coupler.

These couplers may also contain those compounds capable of developing color upon oxidative coupling with aromatic primary amine developers (for example, phenylenediamine derivatives or aminophenyl derivatives) in the color developing processing. For instance, the cyan coupler includes a naphthol coupler, a phenol coupler, etc., and the magenta coupler includes a 5-pyrazolone coupler, a pyrazolobenzimidazole coupler, a cyanoacetyl chroman coupler, a pyrazolotriazole coupler, a closed acyl acetonitrile coupler, etc. The preferred couplers are nondiffusing couplers having hydrophobic groups referred to as the ballast group in the molecule. The couplers may either be tetrameric or dimeric to the silver ions. Further, a colored coupler having a color compensating effect or a coupler releasing a development inhibitor accompanying the development (so called DIR coupler) may be used.

Besides the DIR coupler, it may also contain non-color-forming DIR coupling compounds producing colorless coupling reaction products and releasing development inhibitor.

For improving the sensitivity, increasing the contrast or promoting the development, the photographic emulsion according to the present invention may contain polyalkylene oxides or the derivatives thereof such as ethers, esters and amines, thioether compounds, thiomorpholines, quaternary ammonium salt compounds, urethane derivatives, urea derivatives, imidazole derivatives, 3-pyrazolidones, etc.

In the silver halide photographic emulsion according to the present invention, known water-soluble dyes (for example, oxonol dye, hemioxonol dye and merocyanine dye) besides the dye disclosed in the present invention may be used together as the filter dye, for anti-irradiation or various other purposes. Further, as the spectral sensitizer, known cyanine dyes, merocyanine dyes or hemicyanine dyes besides the dyes shown in the present invention may be used together.

The photographic emulsion according to the present invention includes various surface active agents for various purposes such as coating aid, antistatic agent, for improvement the slippability, for dispersion of emulsion, anti-adhesion, improving photographic properties (for example, promotion of development, tone hardening, sensitization), etc.

Further, the photosensitive material according to the present invention may also be incorporated with various additives such as discoloration inhibitor, film hardening agent, color fogging inhibitor, UV absorber, protective colloid such as gelatin, etc.; specific examples are disclosed in *Research Disclosure*, Vol. 176 (1978, XII), RD 17643, etc.

The finished emulsion is applied onto an adequate support, for example, a baryta paper, a resin coated paper, a synthetic paper, a triacetate film, a polyethylene terephthalate film and other plastic base or glass plate.

The silver halide photographic material according to the present invention includes color positive films, color papers, color negative films color reversion films, etc.

Exposure for obtaining photographic images can be conducted by usual method. Namely, any of known various light sources such as natural light (sunlight), tungsten lamp, fluorescent lamp, mercury lamp, xenon arc lamp, carbon arc lamp, xenon flash lamp, cathode ray tube, flying spot, etc., can be used. The exposure time is usually from 1/1,000 second to 30 seconds, but exposure for a time shorter than 1/1,000 second, for example, exposure of from $1/10^4$ to $1/10^6$ second using a xenon flash lamp or a cathode ray tube may also be employed whereas exposure for longer than 30 seconds may also be used. If required, the spectral composition of light used for the exposure can be adjusted by a color filter. Laser beams may also be used for the exposure. Further, exposure may be conducted by light released from fluorescent substances excited by electron beams, X-rays, $\gamma$-rays, $\alpha$-rays, etc.

A photographic treatment (color photographic treatment) for forming dye images by development is used for the photographic processing of the photosensitive material prepared according to the present invention. The processing temperature is selected usually from 18° C. to 50° C., but it may be a temperature lower than 18° C. or above 50° C.

Any methods for the color photographic treatment can be applied with no particular restrictions. For instance, typical examples thereof include a method comprising color development and bleach-fixing after exposure and further water washing and stabilization as required, a method of color development and separated bleaching and fixing after exposure and, if required, further water washing and stabilization, a method comprising development using a liquid developer containing a black-and-white developing agent after exposure, uniform exposure, followed by color development and bleaching fixation and, if required, further water washing and stabilization, a method comprising development after exposure using a liquid developer containing a black-and-white main developing agent, further development with a color developing solution containing a fogging agent (for example, sodium borohydride), bleach-fixing and, if required, further water washing and stabilization.

The aromatic primary amine color developing agents used for the color developing solution according to the present invention include known agents that have been used generally in various color photographic processes. These developing agents include aminophenol and p-phenylenediamine type derivatives. Preferred examples are p-phenylene derivatives and representative examples are shown below but are not limited thereto.

D- 1 N,N-Diethyl-p-phenylenediamine
D- 2 2-Amino-5-diethylaminotoluene
D- 3 2-Amino-5-(N-ethyl-N-laurylamino)toluene
D- 4 4-[N-Ethyl-N-($\beta$-hydroxyethyl)amino]aniline
D- 5 2-Methyl-4-[N-ethyl-N-($\beta$-hydroxyethyl)amino]-aniline
D- 6 N-Ethyl-N-($\beta$-methanesulfonamidoethyl)-3-methyl-4-aminoaniline
D- 7 N-(2-Amino-5-diethylaminophenylethyl)methanesulfonamide
D- 8 N,N-Dimethyl-p-phenylenediamine
D- 9 4-Amino-3-methyl-N-ethyl-N-methoxyethylaniline
D-10 4-Amino-3-methyl-N-ethyl-N-$\beta$-ethoxyethylaniline
D-11 4-Amino-3-methyl-N-ethyl-N-$\beta$-butoxyethylaniline Further, these p-phenylenediamine derivatives may be salts such as sulfate, hydrochloride, sulfite or p-toluenesulfonate. The above-mentioned compounds are described in U.S. Pat. No. 2,193,015, 2,552,241, 2,566,271, 2,592,364, 3,656,950, 3,698,525 etc. The amount of the aromatic primary amine color developing agent used is about from 0.1 g to 20 g, preferably about from 0.5 g to 10 g, per liter of the developer solution.

The color developing solution used in the present invention may contain hydroxylamines as is well known.

While hydroxylamines can be used in the form of free amines in the color developing solution, they may usually be used in the form of water-soluble acid salts thereof. General examples of such salts are sulfate, oxalate, chloride, phosphate, carbonate, acetate, etc. Hydroxylamines may be substituted or unsubstituted and the nitrogen atom of the hydroxylamine may be substituted with an alkyl group.

The addition amount of the hydroxylamine is preferably from 0 g to 10 g, and more preferably from 0 g to 5 g, per liter of the color developing solution. So long as the stability of the color developing solution can be kept, lesser addition amount is better.

It is also preferred to contain, as preservatives, sulfite such as sodium sulfite, potassium sulfite, sodium hydrogensulfite, potassium hydrogensulfite, sodium metasulfite, potassium metasulfite, etc., as well as carbonyl sulfurous acid addition product. The addition amount of them is preferably from 0 g to 20 g/liter, and more preferably from 0 g to 5 g/liter and lesser addition amount is better so long as the stability of the color developing solution can be kept.

As other preservatives, there can be mentioned aromatic hydroxy compounds described in Japanese Patent Application (OPI) Nos. 49828/77, 47038/81, 32140/81 and 160142/84, and U.S. Pat. No. 3 746,544 (aromatic polyhydroxy compounds); hydroxyacetones described in U.S. Pat. No. 3,615,503 and British Patent 1,306,176; $\alpha$-aminocarbonyl compounds described in Japanese Patent Application (OPI) Nos. 14302/77 and 89425/78; various metals described in Japanese Patent Application (OPI) Nos. 44148/82 and 53749/82; various saccharides described in Japanese Patent Application (OPI) No. 102727/77; hydroxamic acids described in Japanese Patent Application (OPI) No. 27638/77; $\alpha,\alpha'$-dicarbonyl compounds described in Japanese Patent Application (OPI) No. 160141/84; salicylic acids described in Japanese Patent Application (OPI) No. 180588/84; alkanolamines described in Japanese Patent Application (OPI) No. 3532/79; poly(alkyleneimines) described in Japanese Patent Application (OPI) No. 94349/81; gluconic acid derivatives described in Japanese Patent Application (OPI) No. 75647/81. Two or more of these preservatives may be used in combination as required. Particularly, addition of 4,5-dihydroxy-m-benzenedisulfonic acid, poly(ethyleneimine) and triethanolamine is preferred.

The pH of the color developing solution used in the present invention is preferably from 9 to 12, more preferably from 9 to 11. Other known compounds for the developer solution ingredients may also be incorporated to the color developing solution.

Details for the kind and the addition amount of the preservatives, buffers, chelating agents, development promoters, antifoggants, fluorescent whitener, etc., that can be added to the color developing solution are described in Japanese Patent Application No. 63526/87 filed on Mar. 18, 1987 by Fuji Photo Film Co., Ltd with the title of invention "color image forming process", pp. 11 to 19 of the specification.

The processing temperature for the color developing solution according to the present invention is from 20° to 50° C., preferably from 30° to 40° C. The processing time is from 20 seconds to 5 minutes, preferably from 30 seconds to 4 minutes. While less supplemental amount is better, it is from 30 to b 1,000 ml, preferably from 60 to 400 ml, per $m^2$ of the photosensitive material.

Explanation will be then made of the silver removing step in the present invention. Any of the steps, for example, bleaching step-fixing step, fixing step-bleaching fixing step, bleaching step-bleach-fixing step, bleach-fixing step may generally be used for the desilvering step. The desilvering step is conducted for less than 2 minutes, more preferably from 15 seconds to 90 seconds.

As the bleaching solution, bleach-fixing solution and fixing solution used in the present invention, as well as additives and the amount thereof to these solutions described, for example, in pages 20 to 25 of the specification of the above-noted Japanese Patent Application can be applied. Furthermore, water washing and/or stabilization applied after the desilvering treatment can also be conducted by applying the descriptions in pp. 25 to 29 of the specification of the above-noted Japanese Patent Application.

EXAMPLE 1

A multilayer color print paper of the layer structure shown below was prepared on a paper support laminated at both surfaces with polyethylene. The coating solution was prepared as below.

Preparation of the First Layer Coating Solution

To $2.38\times10^{-2}$ mol of each yellow coupler shown in Table 1 and 4.4 g of a color image stabilizer (Cpd-1), 27.2 cc of ethyl acetate and 7.7 cc of solvent (Solv-1) were added and dissolved, and the solution was emulsified and dispersed in 185 cc of an aqueous 10% gelatin solution containing 8 cc of 10% sodium dodecylbenzenesulfonate. On the other hand, a solution was prepared by adding a blue-sensitive sensitizing dye shown below in an amount of $5.0\times10^{-4}$ mol per mol of silver to an emulsion of monodispersed cubic silver bromochloride (containing 80.0 mol% of silver bromide and 70 g of Ag/kg. The emulsified dispersion and the emulsion were mixed and dissolved to prepare a first layer coating solution having the composition shown below. The coating solutions for the second layer to seventh layer were also prepared in the same procedures as for the first layer coating solution. 1-Hydroxy3,5-dichloro-s-triazine sodium salt was used as a gelatin hardener for each of the layers.

As the spectral sensitizing dyes for the respective layers, the following compounds were used.

Blue-Sensitive Emulsion Layer

-continued

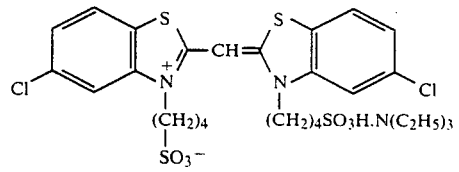

($5.0\times10^{-4}$ mol per mol of silver halide)

Green-Sensitive Emulsion Layer

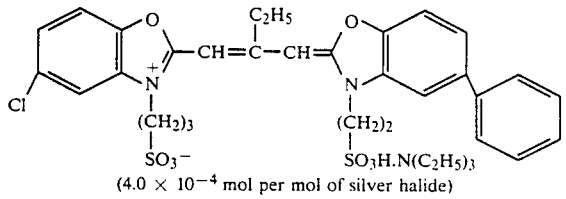

($4.0\times10^{-4}$ mol per mol of silver halide)

and

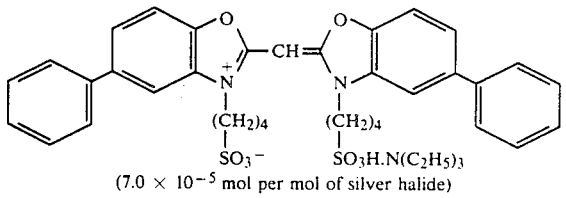

($7.0\times10^{-5}$ mol per mol of silver halide)

Red-Sensitive Emulsion Layer

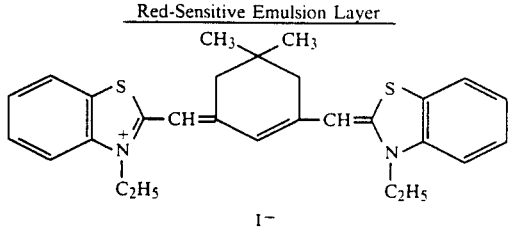

($0.9\times10^{-4}$ mol per mol of silver halide)

For the red-sensitive emulsion layer the following compound was added ($2.6\times10^{-3}$ mol per mol of silver halide).

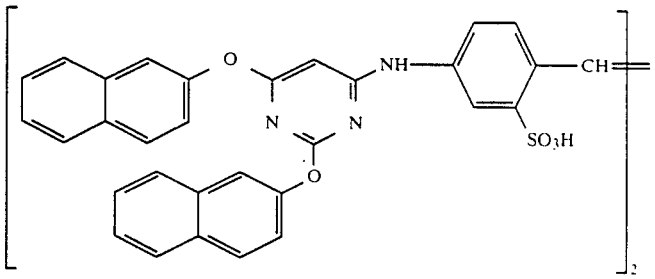

Further, to the blue-sensitive emulsion layer, green-sensitive emulsion layer and red-sensitive emulsion layer, 1-(5-methylureidophenyl)-5-mercaptotetrazole was added in an amount of $4.0\times10^{-6}$ mol, $3.0\times10^{-5}$ mol and $1.0\times10^{-5}$ mol, per mol of the silver halide, respectively.

Further, to the blue-sensitive emulsion layer and the green-sensitive emulsion layer, 4-hydroxy-6-methyl-1,3,3*a*,7-tetraazaindene was added in an amount of $1.2\times10^{-2}$ mol and $1.1\times10^{-2}$ mol, per mol of the silver halide, respectively.

Layer Constitution

The compositions of the layers were as follows. The numericals represent the amount coated (g/m$^2$). The silver halide emulsion is represented by the amount coated of silver.

Support

Polyethylene laminate paper (containing white pigment ($TiO_2$) and blue tinted dye (ultramarine) in the polyethylene on the first layer)

| | |
|---|---|
| First Layer: Blue-Sensitive Layer | |
| Silver halide emulsion (Br: 80%) | Table 1 |
| Gelatin | 1.83 |
| Yellow Coupler (Table 1) | $1.03 \times 10^{-3}$ mol |
| Color image stabilizer (Cpd-1) | 0.19 |
| Solvent (Solv-1) | 0.35 |
| Second Layer: Color Mixing Preventive Layer | |
| Gelatin | 0.99 |
| Color mixing preventing agent (Cpd-2) | 0.08 |
| Third Layer: Green-Sensitive Layer | |
| Silver halide emulsion (Br: 80%) | 0.16 |
| Gelatin | 1.79 |
| Magenta coupler (ExM) | 0.32 |
| Color image stabilizer (Cpd-3) | 0.20 |

-continued

| | |
|---|---|
| Color image stabilizer (Cpd-4) | 0.01 |
| Solvent (Solv-2) | 0.65 |
| Fourth Layer: UV Absorption Layer | |
| Gelatin | 1.58 |
| UV absorber (UV-1) | 0.62 |
| Color mixing preventing agent (Cpd-5) | 0.05 |
| Solvent (Solv-3) | 0.24 |
| Fifth Layer: Red-Sensitive Layer | |
| Silver halide emulsion (Br: 70%) | 0.23 |
| Gelatin | 1.34 |
| Cyan coupler (ExC) | 0.34 |
| Color image stabilizer (Cpd-6) | 0.17 |
| Polymer (Cpd-7) | 0.40 |
| Solvent (Solv-4) | 0.23 |
| Sixth Layer: UV Absorption Layer | |
| Gelatin | 0.53 |
| UV absorber (UV-1) | 0.21 |
| Solvent (Solv-3) | 0.08 |
| Seventh Layer: Protective Layer | |
| Gelatin | 1.33 |
| Acryl modified polyvinyl alcohol copolymer (modification degree of 17%) | 0.17 |
| Liquid paraffin | 0.03 |

A dye was added to the fourth layer for preventing irradiation (Table 1). The amount added is shown in Table 1.

(Cpd-1): Color Image Stabilizer

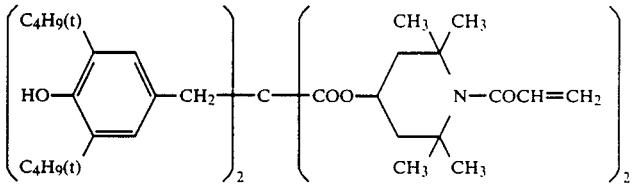

(Cpd-2): Color Mixing Preventing Agent

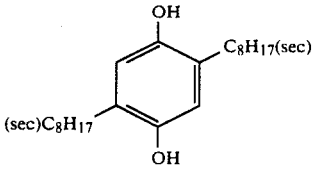

(Cpd-3): Color Image Stabilizer

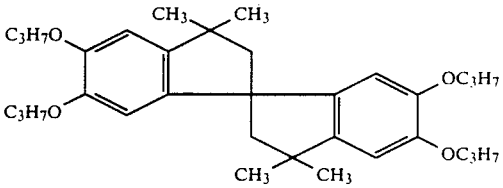

(Cpd-4): Color Image Stabilizer

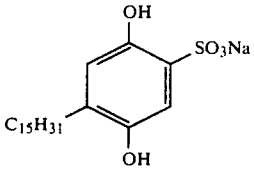

(Cpd-5): Color Mixing Preventing Agent

-continued
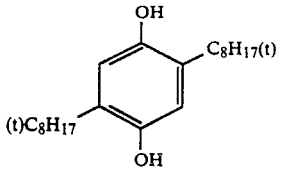
(Cpd-6): Color Image Stabilizer
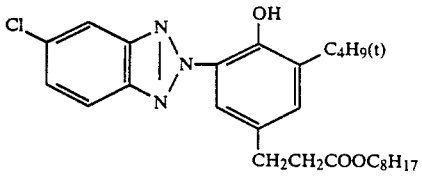
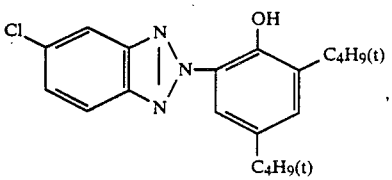
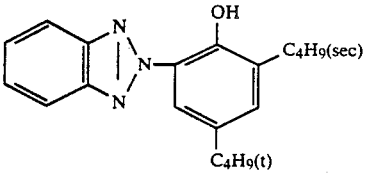
5/8/9 mixture (weight ratio)
(Cpd-7): Polymer
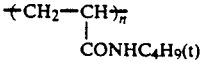
Average molecular weight: 80,000
(UV-1): UV Absorber
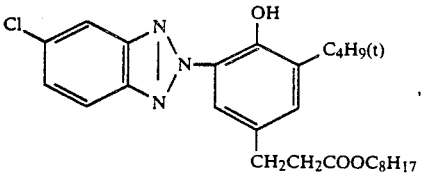
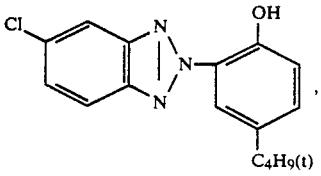
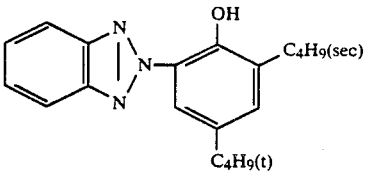
2/9/8 mixture (weight ratio)
(Solv-1): Solvent
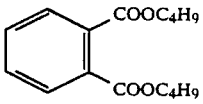

-continued (Solv-2): Solvent

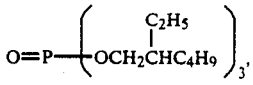

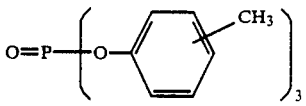

2/1 mixture (volume ratio)

(Solv-3): Solvent $O{=}P{\leftarrow}O{-}C_9H_{19}(iso))_3$ (Solv-4): Solvent

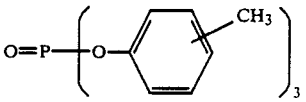

(ExM): Magenta Coupler

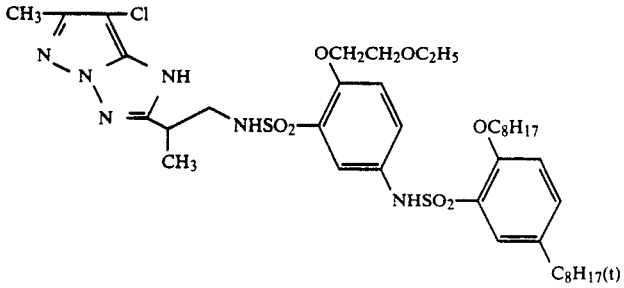

(ExC): Cyan Coupler

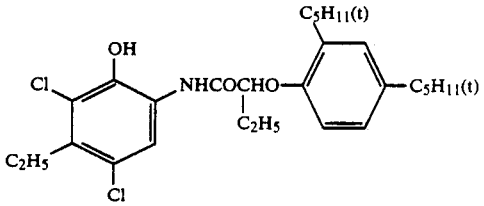

Sample Nos. 1 to 16 shown in Table 1 were prepared by varying the kind of the yellow couplers and the kind of the anti-irradiation dyes in the coated samples described above.

TABLE 1

| Sample No. | Dye Used | Amount Used of Dye (mol/m$^2$) | Yellow Coupler | Amount Coated of Silver in Blue-Sensitive Layer (g/m$^2$) | Remarks |
|---|---|---|---|---|---|
| 1 | I-5 | $2 \times 10^{-5}$ | Y-1 | 0.26 | Invention |
| 2 | " | " | Y-4 | " | " |
| 3 | " | " | Y-10 | " | " |
| 4 | " | " | Y-35 | " | " |
| 5 | " | " | Y-36 | " | " |
| 6 | " | " | Y-38 | " | " |
| 7 | " | " | Y-40 | " | " |
| 8 | " | " | Y (shown below) | 0.52 | Comparison |
| 9 | I-12 | $2 \times 10^{-5}$ | Y-36 | 0.26 | Invention |
| 10 | " | " | Y (shown below) | 0.52 | Comparison |
| 11 | I-10 | $2 \times 10^{-5}$ | Y-36 | 0.26 | Invention |
| 12 | " | " | Y (shown below) | 0.52 | Comparison |
| 13 | I-5 + I-10 | $2 \times 10^{-5} + 2 \times 10^{-5}$ | Y-36 | 0.26 | Invention |
| 14 | " | " | Y (shown below) | 0.52 | Comparison |
| 15 | Comparative dye (shown below) | $2 \times 10^{-5}$ | Y-36 | 0.26 | " |
| 16 | Comparative dye | " | Y (shown below) | 0.52 | " |

TABLE 1-continued

| Sample No. | Dye Used | Amount Used of Dye (mol/m²) | Yellow Coupler | Amount Coated of Silver in Blue-Sensitive Layer (g/m²) | Remarks |
|---|---|---|---|---|---|
| | (shown below) | | | | |

(Y): Comparative Yellow Coupler

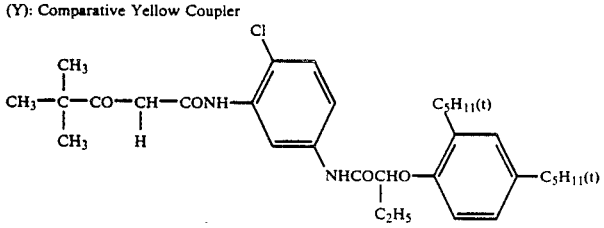

Comparative Dye

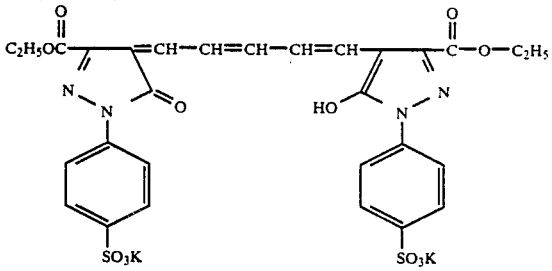

Sample Nos. 1 to 16 were exposed to blue light through an optical wedge. The exposed samples were subjected to the following treatment and evaluated by measuring the relative sensitivity at optical density = 1.0 and the maximum density ($D_{max}$). The results are shown in Table 2.

| Processing Step | Temperature (°C.) | Time |
|---|---|---|
| Color Development | 33 | 3 min 30 sec |
| Bleach-Fixing | 33 | 1 min 30 sec |
| Water Washing | 24–34 | 3 min |
| Drying | 70–80 | 1 min |

The composition for each of the processing solutions is as follows.

| | |
|---|---|
| Color Developing Solution: | |
| Water | 800 ml |
| Diethylenetriaminepentaacetic acid | 1.0 g |
| Nitrilotriacetic acid | 1.5 g |
| Benzyl alcohol | 15 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfate | 5.0 g |
| Hydroxylamine sulfate | 4.0 g |
| Fluorescence whitener (WHITEX 4B, manufactured by Sumitomo Kagaku) | 1.0 g |
| Water to make | 1,000 ml |
| pH (25° C.) | 10.20 |
| Bleach-Fixing Solution: | |
| Water | 400 ml |
| Ammonium thiosulfate (70%) | 150 ml |
| Sodium sulfite | 18 g |
| (Ethylenediaminetetraacetato) Iron(III) | 55 g |
| Disodium ethylenediaminetetraacetate | 5 g |
| Water to make | 1,000 ml |
| pH (25° C.) | 6.70 |

TABLE 2

| Sample No. | Relative Sensitivity (No.15: 100) | $D_{max}$ | Remarks |
|---|---|---|---|
| 1 | 116 | 2.15 | Invention |
| 2 | 112 | 2.11 | " |
| 3 | 108 | 2.08 | " |
| 4 | 109 | 2.09 | " |
| 5 | 110 | 2.10 | " |
| 6 | 113 | 2.12 | " |
| 7 | 115 | 2.14 | " |
| 8 | 102 | 1.98 | Comparison |
| 9 | 110 | 2.11 | Invention |
| 10 | 101 | 2.00 | Comparison |
| 11 | 110 | 2.12 | Invention |
| 12 | 101 | 1.99 | Comparison |
| 13 | 109 | 2.10 | Invention |
| 14 | 100 | 1.98 | Comparison |
| 15 | 100 | 2.02 | " |
| 16 | 97 | 1.96 | " |

As can be seen from Table 2, the sensitivity and the color developability are excellent by the combination of the dye and the yellow coupler according to the present invention.

EXAMPLE 2

Sample Nos. 1 to 16 of Example 1 were treated as in Example 1 but using the following steps and they were evaluated in the same procedures as in Example 1. The results are given in Table 3.

| Processing Step | Temperature (°C.) | Time |
|---|---|---|
| Color Development | 38 | 1 min 40 sec |
| Bleach-Fixing | 30–34 | 1 min 00 sec |
| Rinsing (1) | 30–34 | 20 sec |
| Rinsing (2) | 30–34 | 20 sec |
| Rinsing (3) | 30–34 | 20 sec |
| Drying | 70–80 | 50 sec |

(The rinsing step was carried out by a three-tank countercurrent system in which water flowed from a last rinsing tank (3) to rinsing tank (2) and then to a first rinsing tank (1) and the photographic material passed through the rinsing tanks by first entering rinsing tank (1) and then entering in succession rinsing tanks (2) and (3).)

The compositions for each of the processing solution were as follows.

| | |
|---|---|
| Color Developing Solution: | |
| Water | 800 ml |
| Diethylenetriaminepentaacetic acid | 1.0 g |
| 1-Hydroxyethylidene-1,1-diphosphonic acid (60%) | 2.0 g |
| Nitrilotriacetic acid | 2.0 g |
| Triethylenediamine [1,4-diazabicyclo-(2,2,2)-octane] | 5.0 g |
| Potassium bromide | 0.5 g |
| Potassium carbonate | 30 g |
| N-Ethyl-N-(β-methanesulfonamidoethyl)-3-methyl-4-aminoaniline sulfate | 5.5 g |
| Diethylhydroxylamine | 4.0 g |
| Fluorescence whitener (UVITEX-CK, manufactured by Ciba Geigy) | 1.5 g |
| Water to make | 1,000 ml |
| pH (25° C.) | 10.25 |
| Bleach-Fixing Solution: | |
| Water | 400 ml |
| Ammonium thiosulfate (70%) | 200 ml |
| Sodium sulfite | 20 g |
| Ammonium (ethylenediaminetetraacetato) iron(III) | 60 g |
| Disodium ethylenediaminetetraacetate | 10 g |
| Water to make | 1,000 ml |
| pH (25° C.) | 7.00 |

Rinsing Solution

Ion exchanged water (containing less than 3 ppm of each of calcium and magnesium)

TABLE 3

| Sample No. | Relative Sensitivity (No. 15: 100) | $D_{max}$ |
|---|---|---|
| 1 | 121 | 2.08 |
| 2 | 117 | 2.07 |
| 3 | 114 | 2.06 |
| 4 | 116 | 2.08 |
| 5 | 115 | 2.05 |
| 6 | 118 | 2.02 |
| 7 | 121 | 2.03 |
| 8 | 97 | 1.87 |
| 9 | 113 | 2.04 |
| 10 | 96 | 1.87 |

TABLE 3-continued

| Sample No. | Relative Sensitivity (No. 15: 100) | $D_{max}$ |
|---|---|---|
| 11 | 113 | 2.03 |
| 12 | 96 | 1.86 |
| 13 | 112 | 2.01 |
| 14 | 95 | 1.85 |
| 15 | 100 | 1.92 |
| 16 | 94 | 1.83 |

As can be seen from Table 3, the sensitivity and the color developability are made excellent by the combination of the dye and the yellow coupler according to the present invention.

EXAMPLE 3

A multilayer color print paper of the layer structure shown below was prepared on a paper support laminated on both surfaces with polyethylene. The coating solution was prepared as follows.

Preparation of the First Layer Coating Solution

To $2.38\times10^{-2}$ mol of each yellow coupler shown in Table 4 and 4.4 g of a color image stabilizer (Cpd-1), 27.2 cc of ethyl acetate and 7.7 cc of solvent (Solv-1) were added and dissolved, and the solution was emulsified and dispersed in 185 cc of an aqueous 10% gelatin solution containing 8 cc of 10% sodium dodecylbenzenesulfonate On the other hand, a solution was prepared by adding a blue-sensitive sensitizing dye shown below in an amount of $5.0\times10^{-4}$ mol per mol of silver to a silver bromochloride (containing 1.0 mol% of silver bromide and 70 g of Ag/kg. The emulsified dispersion and the emulsion were mixed and dissolved to prepare a first layer coating solution having the composition shown below. The coating solutions for the second layer to the seventh layer were also prepared in the same procedures as in the first layer. 1-Hydroxy-3,5-dichloro-s-triazine sodium salt was used as the gelatin hardener for each of the layers.

As the spectral sensitizing dyes for the respective layers, the following compounds were used.

Blue -Sensitive Emulsion Layer

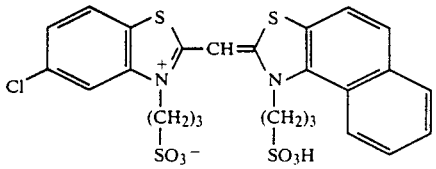

($5.0\times10^{-4}$ mol per mol of silver halide)

Green-Sensitive Emulsion Layer

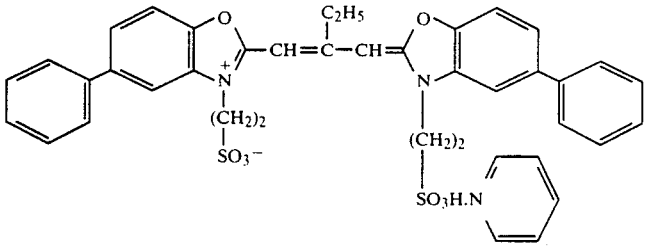

($4.0\times10^{-4}$ mol per mol of silver halide)

and

-continued

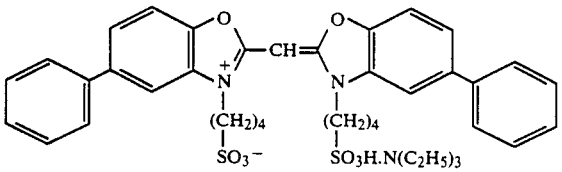

($7.0 \times 10^{-5}$ mol per mol of silver halide)

Red-Sensitive Emulsion Layer

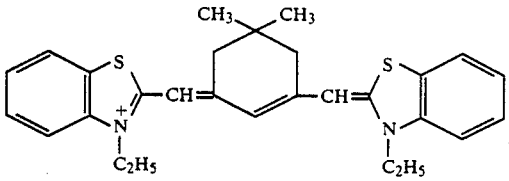

($0.9 \times 10^{-4}$ mol per mol of silver halide)

For the red-sensitive emulsion layer, the following compound was added in an amount of $2.6 \times 10^{-3}$ mol per mol of silver halide.

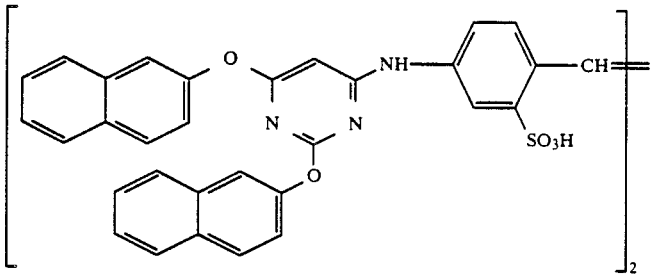

Further, to the blue-sensitive emulsion layer, green-sensitive emulsion layer and red-sensitive emulsion layer, 1-(5-methylureidophenyl)-5-mercaptotetrazole were added in an amount of $8.5 \times 10^{-5}$ mol, $7.7 \times 10^{-4}$ mol and $2.5 \times 10^{-4}$ mol per mol of silver halide, respectively.

Layer Constitution

The compositions of the layers were as follows. The numericals represent the amount coated (g/m$^2$ ). The silver halide emulsion is represented as the amount coated of silver.

Support

Polyethylene laminate paper (containing white pigment ($TiO_2$) and blue tinted dye (ultramarine) to the polyethylene on the first layer)

| | |
|---|---|
| First Layer: Blue-Sensitive Layer | |
| Silver halide emulsion (Br: 1 mol %) | Table 4 |
| Gelatin | 1.86 |
| Yellow coupler (Table 4) | $1.03 \times 10^{-3}$ mol |
| Color image stabilizer (Cpd-1) | 0.19 |
| Solvent (Solv-1) | 0.35 |
| Second Layer: Color Mixing Preventive Layer | |
| Gelatin | 0.99 |

-continued

| | |
|---|---|
| Color mixing preventing agent (Cpd-2) | 0.08 |
| Third Layer: Green-Sensitive Layer | |
| Silver halide emulsion (Br: 1 mol %) | 0.36 |
| Gelatin | 1.24 |
| Magenta coupler (ExM) | 0.31 |
| Color image stabilizer (Cpd-3) | 0.25 |
| Color image stabilizer (Cpd-4) | 0.12 |
| Solvent (Solv-2) | 0.42 |
| Fourth Layer: UV Absorption Layer | |
| Gelatin | 1.58 |
| UV Absorber (UV-1) | 0.62 |
| Color mixing preventing agent (Cpd-5) | 0.05 |
| Solvent (Solv-3) | 0.24 |
| Fifth Layer: Red-Sensitive Layer | |
| Silver halide emulsion (Br: 1 mol %) | 0.23 |
| Gelatin | 1.34 |
| Cyan coupler (ExC) | 0.34 |
| Color image stabilizer (Cpd-6) | 0.17 |
| Polymer (Cpd-7) | 0.40 |
| Solvent (Solv-4) | 0.23 |
| Sixth Layer: UV Absorption Layer | |
| Gelatin | 0.53 |
| UV Absorber (UV-1) | 0.21 |
| Solvent (Solv-3) | 0.08 |
| Seventh Layer: Protective Layer | |
| Gelatin | 1.33 |
| Acryl modified polyvinyl alcohol copolymer (modification degree of 17%) | 0.17 |
| Liquid paraffin | 0.03 |

A dye was added to the fourth layer for preventing irradiation (Table 4). The amount added is shown in Table 4.

(Cpd-1): Color Image Stabilizer

-continued
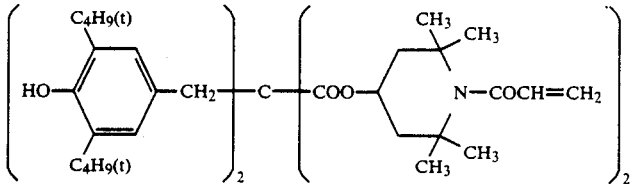
(Cpd-2) Color Mixing Inhibitor
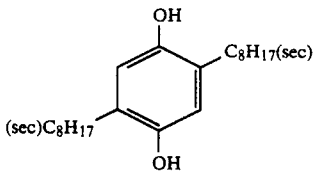
(Cpd-3): Color Image Stabilizer
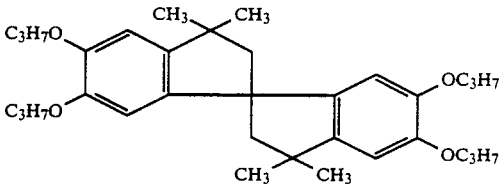
(Cpd-4): Color Image Stabilizer
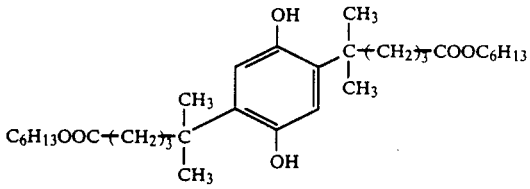
(Cpd-5): Color Mixing Preventing Agent
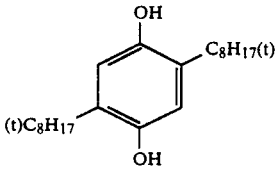
(Cpd-6): Color Image Stabilizer
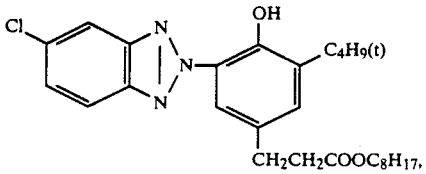
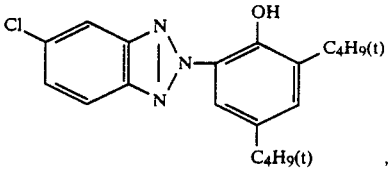
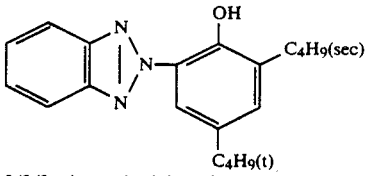
5/8/9 mixture (weight ratio)

-continued
(Cpd-7): Polymer
$$-(CH_2-\underset{\underset{CONHC_4H_9(t)}{|}}{CH})_n-$$
Average molecular weight: 80,000
(UV-1): UV Absorber
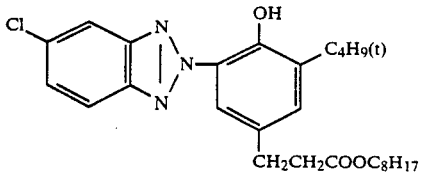
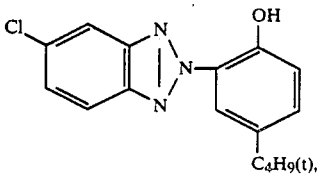
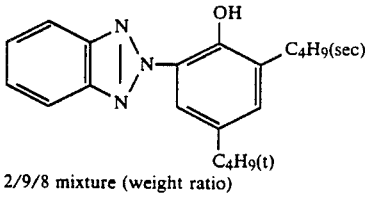
2/9/8 mixture (weight ratio)
(Solv-1): Solvent
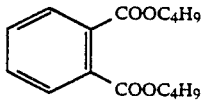
(Solv-2): Solvent
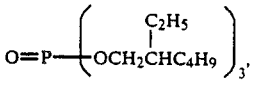
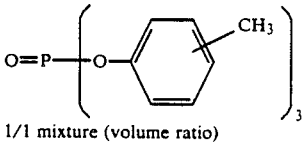
1/1 mixture (volume ratio)
(Solv-3): Solvent
$O{=}P{-}(O{-}C_9H_{19}(iso))_3$
(Solv-4): Solvent
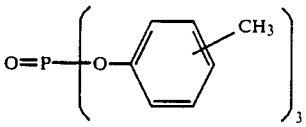
(ExM): Magenta Coupler:

-continued

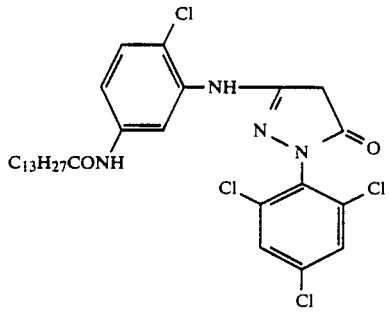

(ExC): Cyan Coupler

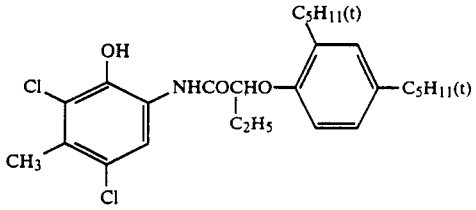

Sample Nos. 17 to 32 as shown in Table 4 were prepared by varying the kind of the yellow couplers and the kind of the anti-irradiation dyes in the coated samples as described above.

TABLE 4

| Sample No. | Dye Used | Amount Used of Dye (mol/m$^2$) | Yellow Coupler | Amount Coated of Silver in Blue-Sensitive Layer (g/m$^2$) | Remarks |
|---|---|---|---|---|---|
| 17 | I-37 | $2 \times 10^{-5}$ | Y-1 | 0.30 | Invention |
| 18 | " | " | Y-4 | " | " |
| 19 | " | " | Y-8 | " | " |
| 20 | " | " | Y-35 | " | " |
| 21 | " | " | Y-36 | " | " |
| 22 | " | " | Y-38 | " | " |
| 23 | " | " | Y-39 | " | " |
| 24 | " | " | Y (Refer to Example 1) | 0.60 | Comparison |
| 25 | I-34 | $2 \times 10^{-5}$ | Y-35 | 0.30 | Invention |
| 26 | " | " | Y | 0.60 | Comparison |
| 27 | I-10 | $2 \times 10^{-5}$ | Y-35 | 0.30 | Invention |
| 28 | " | " | Y | 0.60 | Comparison |
| 29 | I-37 + I-10 | $2 \times 10^{-5} + 2 \times 10^{-5}$ | Y-35 | 0.30 | Invention |
| 30 | " | " | Y | 0.60 | Comparison |
| 31 | Comparative dye (Refer to Example 1) | $2 \times 10^{-5}$ | Y-35 | 0.30 | " |
| 32 | Comparative dye (Refer to Example 1) | " | Y | 0.60 | " |

Samples Nos. 17 to 32 were exposed to blue light through an optical wedge. The exposed samples were subjected to the following treatment and evaluated by measuring the relative sensitivity at optical density = 1.0 and maximum density ($D_{max}$). The results are shown in Table 5.

| Processing Step | Temperature (°C.) | Time (sec) |
|---|---|---|
| Color Development | 35 | 45 |
| Bleach-Fixing | 30–35 | 45 |
| Rinsing (1) | 30–35 | 20 |
| Rinsing (2) | 30–35 | 20 |
| Rinsing (3) | 30–35 | 20 |
| Rinsing (4) | 10–35 | 30 |

-continued

| Processing Step | Temperature (°C.) | Time (sec) |
|---|---|---|
| Drying | 70–80 | 60 |

(The rinsing step was carried out by a four-tank countercurrent system in which water flowed from a last rinsing tank (4) and then in succession to rinsing tank (1) and the photographic material passed through the rinsing tanks in countercurrent by first entering tank (1) and then entering in succession tanks (2), (3) and (4).)

The compositions of the processing solutions were as below.

| Color Developing Solution: | |
|---|---|
| Water | 800 ml |
| Ethylenediamine-N,N,N',N'-tetramethylenephosphonic acid | 1.5 g |
| Triethylenediamine[1,4-diazabicyclo-(2,2,2)octane] | 5.0 g |
| Sodium chloride | 1.4 g |
| Potassium carbonate | 25 g |
| N-Ethyl-N-(8-methanesulfonamidoethyl)-3-methyl-4-aminoaniline sulfate | 5.0 g |
| N,N-Diethylhydroxylamine | 4.2 g |
| Fluorescence whitener (UVITEX CK, manufactured by Ciba Geigy) | 2.0 g |

-continued

| | |
|---|---|
| Water to make | 1,000 m |
| pH (25° C.) | 10.10 |
| Bleach-Fixing Solution: | |
| Water | 400 ml |
| Ammonium thiosulfate (70%) | 100 ml |
| Sodium sulfite | 18 g |
| Ammonium (ethylenediaminetetraacetato) iron(III) | 55 g |
| Disodium ethylenediaminetetraacetate | 3 g |
| Ammonium bromide | 40 g |
| Glacial acetic acid | 8 g |
| Water to make | 1,000 ml |
| pH (25° C.) | 5.5 |

Rinsing Solution

Ion exchanged water (containing less than 3 ppm of each of calcium, magnesium).

TABLE 5

| Sample No. | Relative Sensitivity (No. 31: 100) | $D_{max}$ | Remarks |
|---|---|---|---|
| 17 | 115 | 2.18 | Invention |
| 18 | 111 | 2.17 | " |
| 19 | 108 | 2.13 | " |
| 20 | 109 | 2.16 | " |
| 21 | 109 | 2.15 | " |
| 22 | 112 | 2.13 | " |
| 23 | 114 | 2.14 | " |
| 24 | 97 | 1.99 | Comparison |
| 25 | 111 | 2.15 | Invention |
| 26 | 98 | 2.00 | Comparison |
| 27 | 111 | 2.16 | Invention |
| 28 | 98 | 2.01 | Comparison |
| 29 | 110 | 2.14 | Invention |
| 30 | 97 | 1.99 | Comparison |
| 31 | 100 | 2.03 | " |
| 32 | 95 | 1.97 | " |

As can be seen from Table 5, the sensitivity and the color developability are made excellent by the combination of the dye and the yellow coupler in accordance with the present invention.

The color photographic material excellent in the sensitivity and the color developability can be obtained by the combination of the dye and yellow coupler according to the present invention.

Further, the color photographic material of excellent sharpness can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material containing at least one of the dyes represented by general formula (I) and containing a coupler represented by general formula (II) in a blue-sensitive layer:

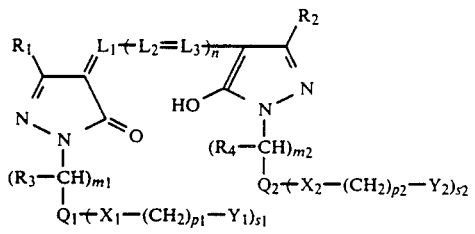

(I)

wherein $R_1$ and $R_2$ each represents —$COOR_5$ or

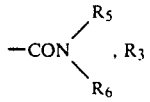

and $R_4$ each represents a hydrogen atom or an alkyl group, $R_5$ and $R_6$ each represents a hydrogen atom, anaalkyl group or an aryl group, $R_5$ and $R_6$ may be bonded to form a 5- or 6-membered ring, $Q_1$ and $Q_2$ each represents an aryl group, $X_1$ and $X_2$ each represents a single bond or a bivalent linking group, $Y_1$ and $Y_2$ each represents a sulfo group or a carboxyl group, $L_1$, $L_2$ and $L_3$ each represents a methine group, $m_1$ and $m_2$ each represents 1 or 2, n represents 0, 1, or 2, $p_1$ and $p_2$ each represents 0, 1, 2, 3 or 4 and $s_1$ and $s_2$ each represents 1 or 2;

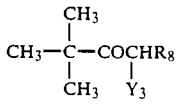

(II)

wherein $R_8$ represents a substituted or unsubstituted N-phenylcarbamoyl group, $Y_3$ represents a group bonded through an oxygen atom or a nitrogen atom and capable of being released by coupling reaction with an oxidation product of a developing agent.

2. A silver halide photographic material as in claim 1, wherein the alkyl group represented by $R_5$ and $R_6$ contains a substituent selected from the group consisting of a sulfo group, a carboxyl group, a hydroxyl group, an alkoxy group, a halogen atom, a cyano group, a sulfonyl group, a nitro group, an amino group and an aryl group.

3. A silver halide photographic material as in claim 1, wherein $R_5$ and $R_6$ are bonded to form a morpholino group, a pyrrolidine group, or a piperidino group.

4. A silver halide photographic material as in claim 1, wherein $Q_1$ and $Q_2$ each represents a phenyl group, a naphthyl group or a substituted phenyl group.

5. A silver halide photographic material as in claim 1, wherein $X_1$ and $X_2$ each represents a bivalent linking group selected from the group consisting of

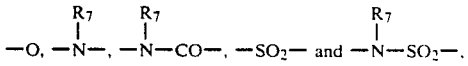

in which $R_7$ represents a hydrogen atom, an alkyl group with 5 or less carbon atoms or a substituted alkyl group with 5 or less carbon atoms.

6. A silver halide photographic material as in claim 1, wherein $Y_1$ and $Y_2$ each represents a sulfo group or a carboxyl group, which may form a salt.

7. A silver halide photographic material as in claim 1, wherein $R_3$ and $R_4$ each represents a methyl group or an ethyl group.

8. A silver halide photographic material as in claim 1, wherein $R_5$ and $R_6$ each represents an alkyl group with 4 or less carbon atoms or a substituted alkyl group with 6 or less carbon atoms.

9. A silver halide photographic material as in claim 1, wherein $Q_1$ and $Q_2$ each represents a phenyl group, or a substituted phenyl group containing a substituent selected from the group consisting of an alkyl group with 4 or less carbon atoms, an alkoxy group with 4 or less carbon atoms and a halogen atom, and a dialkylamino group with 4 or less carbon atoms.

10. A silver halide photographic material as in claim 1, wherein $m_1 = m_2 = 1$.

11. A silver halide photographic material as in claim 1, wherein $R_8$ is represented by general formula (A):

(A)

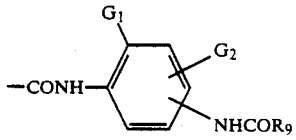

wherein $G_1$ represents a halogen atom or an alkoxy group and $G_2$ represents a hydrogen atom, a halogen atom or an alkyl group which may have a substituent and $R_9$ represents an alkyl group which may have a substituent.

12. A silver halide photographic material as in claim 1, wherein releasable group $Y_3$ includes the groups represented by the following general formulae from (B) to (E):

$$-OR_{10} \quad \text{(B)}$$

wherein $R_{10}$ represents an aryl group or a heterocyclic group which may be further substituted;

(C)

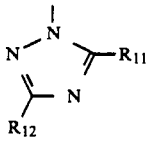

(D)

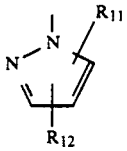

wherein $R_{11}$ and $R_{12}$ each represents a hydrogen atom, a halogen atom, a carboxylic acid ester group, an amino group, an alkyl group, an alkylthio group, an alkoxy group, an alkylsulfonyl group, an alkylsulfinyl group, a carboxyl group, a sulfo group, an unsubstituted or substituted phenyl group, or a heterocyclic ring, which may be the same or different;

(E)

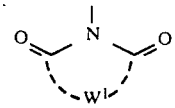

wherein $W_1$ represents a nonmetal atom required for forming a 4-membered, a 5-membered, or a 6-membered ring together with

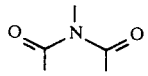

in the formula.

13. A silver halide photographic material as in claim 12, wherein the releasable group represented by general formula (E) is selected from the group consisting of the following formulae (E-1), (E-2) and (E-3):

(E-1)

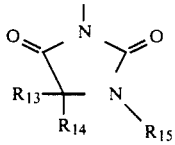

(E-2)

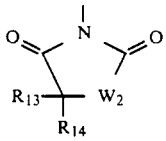

(E-3)

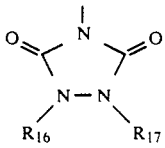

wherein $R_{13}$ and $R_{14}$ each represents a hydrogen atom, an alkyl group, an aryl group, an alkoxy group, an aryloxy group or a hydroxyl group, $R_{15}$, $R_{16}$ and $R_{17}$ each represents a hydrogen atom, an alkyl group, an aryl group, an aralkyl group or an acyl group and $W_2$ represents an oxygen or sulfur atom.

14. The silver halide photographic material according to claim 1, wherein $m_1$ and $m_2$ are each 2.

15. The silver halide photographic material according to claim 1, wherein $R_3$ and $R_4$ each represent an alkyl group.

* * * * *